US007371146B2

(12) United States Patent
Scarborough

(10) Patent No.: US 7,371,146 B2
(45) Date of Patent: May 13, 2008

(54) TOY CONSTRUCTION SET METHOD AND APPARATUS

(76) Inventor: Dane Scarborough, P.O. Box 3351, Hailey, ID (US) 83333-3351

( * ) Notice: Subject to any disclaimer, the term of this patent is extended or adjusted under 35 U.S.C. 154(b) by 290 days.

(21) Appl. No.: 11/055,723

(22) Filed: Feb. 9, 2005

(65) Prior Publication Data

US 2006/0046604 A1 Mar. 2, 2006

Related U.S. Application Data

(60) Provisional application No. 60/607,241, filed on Sep. 2, 2004.

(51) Int. Cl.
*A63H 33/04* (2006.01)

(52) U.S. Cl. ..... 446/85; 446/108; 446/122; 446/124

(58) Field of Classification Search ..... 446/85, 446/100, 104, 106, 108, 113, 117, 120, 122, 446/124, 126; 403/171, 174
See application file for complete search history.

(56) References Cited

U.S. PATENT DOCUMENTS

| | | | | |
|---|---|---|---|---|
| 1,113,371 | A | 10/1914 | Pajeau | |
| 1,198,263 | A | 9/1916 | Pajeau | |
| 1,678,709 | A | 7/1928 | Schurmann | |
| 1,851,159 | A | 3/1932 | Dodge | |
| 2,633,662 | A | 4/1953 | Nelson | |
| 2,701,152 | A * | 2/1955 | Cutler | 280/514 |
| 2,844,910 | A | 7/1958 | Korchak | |
| 3,233,358 | A | 2/1966 | Dehm | |
| 3,452,989 | A | 7/1969 | Jernstrom | |
| 3,550,311 | A | 12/1970 | Fouquart | |
| 3,648,404 | A | 3/1972 | Ogsbury et al. | |
| 3,698,123 | A | 10/1972 | Heldt | |
| 3,808,737 | A | 5/1974 | Abrams | |
| 3,927,489 | A | 12/1975 | Bernstein | |
| 4,078,328 | A | 3/1978 | Rayment | |
| D254,752 | S | 4/1980 | Gabriel | |
| 4,453,719 | A | 6/1984 | McKean | |
| 4,548,590 | A | 10/1985 | Green | |
| 4,701,131 | A | 10/1987 | Hildebrandt et al. | |
| 4,740,188 | A | 4/1988 | Coster | |
| 4,758,196 | A | 7/1988 | Wang | |
| 5,044,960 | A | 9/1991 | De Porteous | |
| RE33,785 | E | 12/1991 | Hildebrandt et al. | |
| 5,121,526 | A | 6/1992 | Burkard et al. | |

(Continued)

OTHER PUBLICATIONS

Int'l Patent Classification 6: A63H 33/09, "Genderless Construction System," Int'l Publication No. WO 97/45183, Int'l Publication Date: Apr. 12, 1997, Int'l Application No. PCT/US97/09107, Inventors: Clever, Haddonfield, NJ and Lyons, Parkland, PA.

(Continued)

*Primary Examiner*—Kien Nguyen
(74) *Attorney, Agent, or Firm*—Stephen M. Nipper; Dykas, Shaver & Nipper, LLP

(57) ABSTRACT

The present invention is an improved construction toy set having a number of different structural elements which are configured for snapping together. These elements having key connectors configured for mating together, where integral locking indentations in the key connectors are configured for locking onto locking ridges provided on the adjacent structural element.

25 Claims, 38 Drawing Sheets

U.S. PATENT DOCUMENTS

| | | | |
|---|---|---|---|
| 5,137,486 | A | 8/1992 | Glickman |
| D334,953 | S | 4/1993 | Kawahara et al. |
| 5,199,919 | A | 4/1993 | Glickman |
| 5,238,438 | A | 8/1993 | Glickman |
| 5,350,331 | A | 9/1994 | Glickman |
| 5,368,514 | A | 11/1994 | Glickman et al. |
| D367,897 | S | 3/1996 | Schmidt et al. |
| 5,527,201 | A | 6/1996 | Maddock |
| 5,605,486 | A | 2/1997 | Zheng |
| 5,645,463 | A | 7/1997 | Olsen |
| D394,091 | S | 5/1998 | Parry |
| 5,853,313 | A | 12/1998 | Zheng |
| 5,897,417 | A | 4/1999 | Grey |
| D409,677 | S | 5/1999 | Jensen |
| 5,904,606 | A | 5/1999 | Zimmer et al. |
| D410,704 | S | 6/1999 | Krog |
| D410,973 | S | 6/1999 | Jensen |
| 5,928,051 | A | 7/1999 | Krog |
| 5,984,756 | A | 11/1999 | Krog |
| D420,710 | S | 2/2000 | Poulsen |
| 6,116,981 | A | 9/2000 | Zheng |
| 6,231,416 | B1 | 5/2001 | Clever et al. |
| 6,325,694 | B1 | 12/2001 | Clever et al. |
| 6,672,931 | B1 | 1/2004 | Bagley |
| 6,676,474 | B2 | 1/2004 | Glickman |

OTHER PUBLICATIONS

HTTP://WWW2.GRAND-FORKS.K12.ND.US/MS/IDITAROD/IMAGES, Aug. 17, 2004, 1 Page.

"Craft Stick Comparisons," Pionus Parrot, HTTP://WWW.PIONUSPARROT.COM/STICKSVIEW.HTM, Aug. 17, 2004, 2 Pages.

International Search Report for PCT/US05/04760, PCT Application Claiming Priority From US 11055723.

* cited by examiner

TOY CONSTRUCTION SET METHOD AND APPARATUS

PRIORITY

This application claims the priority date of the provisional application entitled TOY CONSTRUCTION SET METHOD AND APPARATUS filed by Dane Scarborough on Sep. 2, 2004 with application Ser. No. 60/607,241.

BACKGROUND OF THE INVENTION

1. Field of the Invention

The present invention generally relates to toys, and more particularly relates to interlocking building sets.

2. Background Information

There are lots of different types of building sets currently on the market including, but not limited to Tinker Toys® and K'NEX®. Both the Tinker Toys® and K'NEX® systems tend to be hub based, which have hubs that are interconnected with struts to form structures. What is needed is a new and unique building set that gives children additional ways in which to be creative, including the ability to use objects and materials that children already have for incorporation within the creations they make. The present invention solves this need.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is an improved construction toy set.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
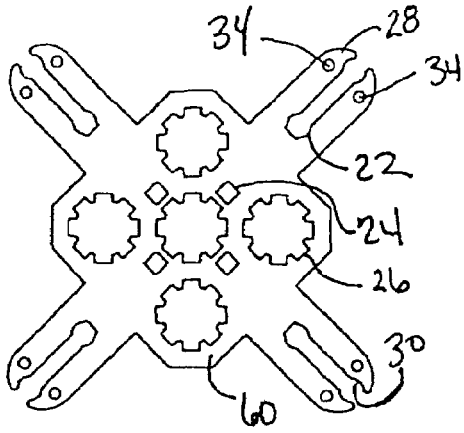
FIG. 1 shows a plan view of a first embodiment of a structural element of the present invention.
Figure 2:
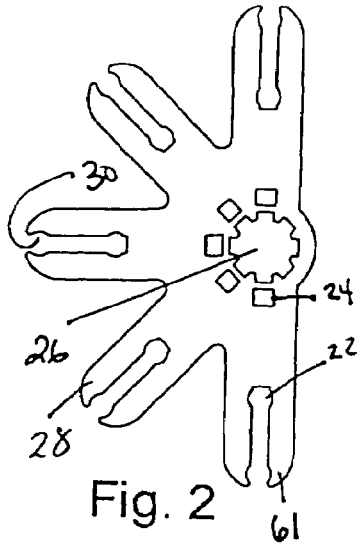
FIG. 2 shows a plan view of a second embodiment of a structural element of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a construction/building set system. The invented system is configured not only for utilization with pre-designed pieces, but also includes the ability for individuals (children) to use items and devices they have lying around at home within the system. For instance a child may be able to use paperclips, rubber bands, empty water bottles, etc., thereby encouraging children to be more creative as well as to reuse or recycle materials around them.

In this disclosure, the invention will be discussed generally as well as some embodiments discussed specifically. Specifically discussed in this disclosure will a number of the preferred types of connectors as well as the various types of connections that can be made. Obviously other types of connectors and connections exist and will be readily apparent to those reading this disclosure and are thereby anticipated as being included herein.

The Figures (FIGS. 1-89) show a number of different embodiments of structural pieces embodying the present invention's teachings. These structural pieces include (for example) call out numbers 40, 60, 61, 62, 63, 64, 65, 66, 67, 68, 69, 70, 160, 161, 162, 163, 164, 166, 168, 170, 172, 174, 176, 178, 180, 181, 182, 183, 190, 191, 192, 220, and 225.

Typically, these individual structural pieces each consist of a number of different components and concepts which work together to form the present invention. As such, rather than discuss each different structural piece at length, this disclosure will discuss the theory behind the present invention while using the various embodiments shown in the drawings as representative examples.

Referring initially to FIG. 1, shown is a structural piece 60 having a number of different connectors thereon. A first type of connector shown is a key connector 28. A "key connector" (when shown or discussed herein) can be configured for locking and/or can be configured for pivoting. The key connector 28 shown is configured for both, having locking portions 30 as well as pivot portions 22. Compare FIG. 1 to FIG. 6. In FIG. 6 the key connectors 28 do not have locking portions nor do they have pivot portions. Utilization of such locking and pivot portions will be discussed later in this disclosure.

Some of such structural pieces of the present invention have the ability to lock or "interlock" together. This is typically done through use of a key-to-key or structural piece to structural piece locking style connection. An example of interlocking structural pieces can be seen in FIG. 20. Referring back to FIG. 1 et al., the structural pieces can have key connectors 28 having integral depressions/indentions 30 therein which are configured for snap fit locking onto locking ridges 24 of the second structural piece with which it connects. In such an arrangement, the keys define a channel or slot there-between, the channels of two connecting structural pieces sliding together and locking through use of the key connectors 28 locking onto the opposing locking ridges 24.

As such, a key connector 28 that is configured for locking will typically have associated therewith and adjacent therefrom a locking ridge 24 configured for attachment to a key connector on a second structural piece. In the context of FIG. 1, each of the four key connectors 28 extending therefrom have associated therewith a locking ridge 24 which is located towards the center of the structural piece 60.

Figure 21:
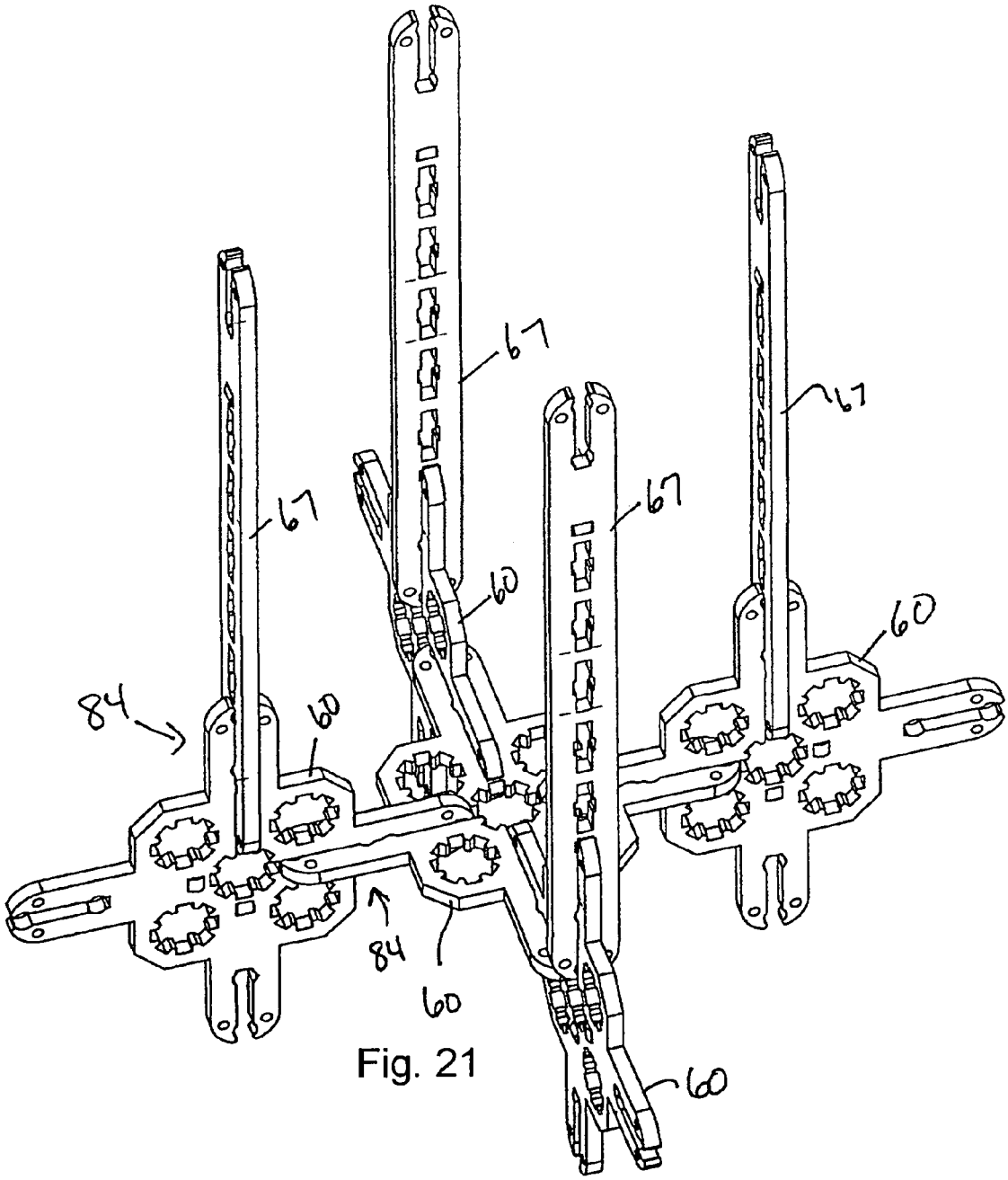
FIG. 21 is a perspective view of one example of a structure built using the present invention.

If we refer now to FIG. 21, shown is utilization of such first structural pieces 60 interlocking together. In this embodiment the interlocking takes place at generally right angles so that the key connectors are able to slide together and lock together when the opposing key connector depressions receive therein the opposing locking ridges of the other structural piece. Such a connection is referred to herein as a key-to-key connection and is typically represented by the call out number 84. In this drawing, two different styles of such a key-to-key connection 84 are shown. For instance, showing two adjacent structural pieces 60, 60 being connected together and also in showing the connection of a structural piece 67 to a structural piece 60. In both contexts the key connectors are slid together and the locking ridge 24 is held within the key connector depressions 30 thereby locking the piece on. It is preferred that the pieces be made out of plastic so that they can be snap fit together with the plastic giving slightly to allow the locking ridge to slide into the key connector locking portion 30.

Referring back to drawing FIG. 1, also shown is the utilization of angular orientation holes 26. The particular angular orientation holes 26 shown are generally star shaped having a vertical channel, a horizontal channel and two opposing angular channels there between. Such an angular orientation hole 26 allows a popsicle stick, a main portion, a body portion of one of the appendages of another structural piece, etc. to be inserted there through. As such, the angular orientation holes form a slot through which another piece can be inserted. It is preferred that horizontal, vertical and diagonal angular orientation holes be provided. While this is preferred, obviously generally X shaped or generally Y shaped slots could be provided in the alternative.

Figure 3:
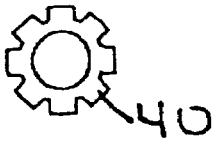
FIG. 3 shows an end view of a third embodiment of a structural element of the present invention.
Figure 4:
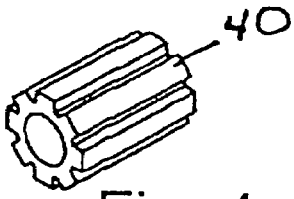
FIG. 4 shows a perspective view of the embodiment of FIG. 3.

In FIGS. 3 and 4, shown are two views of a cylindrical connector 40. Such a cylindrical connector 40 obviously could be longer or shorter than what is shown. Such cylindrical connectors are allowed to slide through a plurality of angular orientation holes thereby locking a plurality of structural pieces together.

The structural pieces optionally have one or more accessory hole connectors 34, for instance the accessory hole connectors of structural piece 60 of FIG. 1. While these accessory hole connectors 34 are shown paired on the ends of the key connectors 28 in that particular drawing, obviously these holes 34 could be located anywhere along the structural piece itself. Such accessory hole connectors 34 for allowing a user to attach additional things thereto, for instance paper clips, strings, twine, etc.

Figure 5:
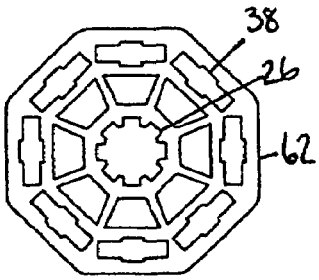
FIG. 5 shows a plan view of a fourth embodiment of a structural element of the present invention.
Figure 6:
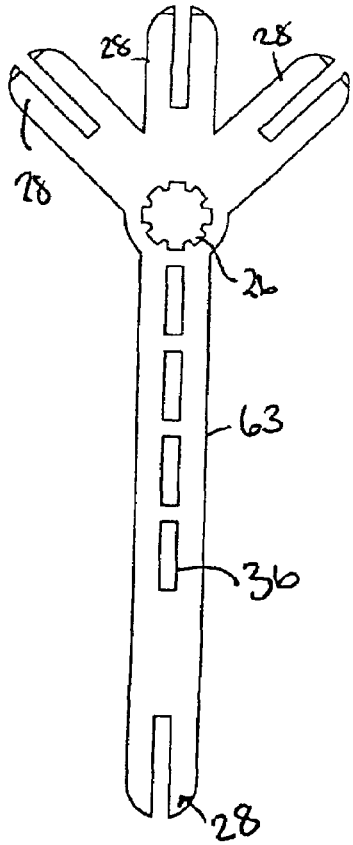
FIG. 6 shows a plan view of a fifth embodiment of a structural element of the present invention.
Figure 7:
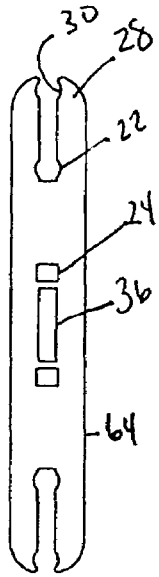
FIG. 7 shows a plan view of a sixth embodiment of a structural element of the present invention.
Figure 8:
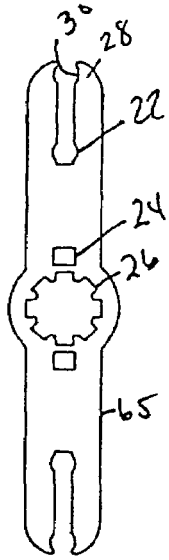
FIG. 8 shows a plan view of a seventh embodiment of a structural element of the present invention.
Figure 9:
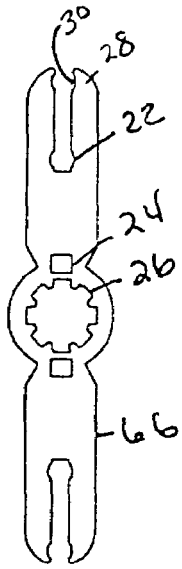
FIG. 9 shows a plan view of an eighth embodiment of a structural element of the present invention.
Figure 10:
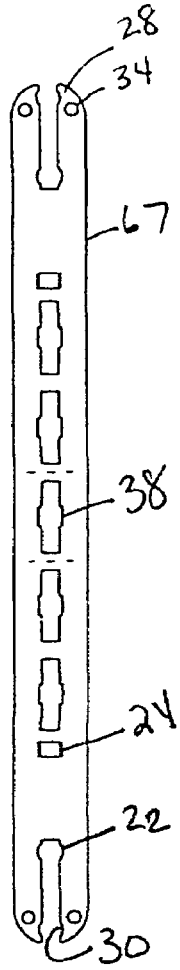
FIG. 10 shows a plan view of a ninth embodiment of a structural element of the present invention.
Figure 51:
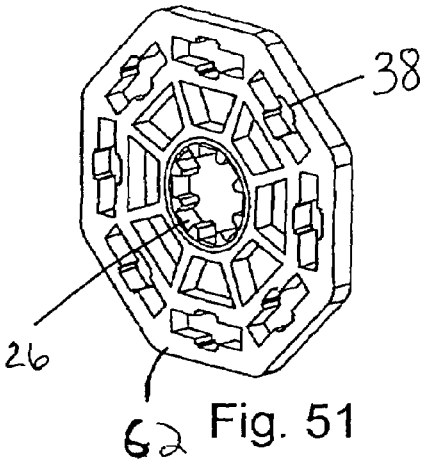
FIG. 51 shows a perspective view of the fourth embodiment of a structural element of the present invention shown in FIG. 5.
Figure 52:
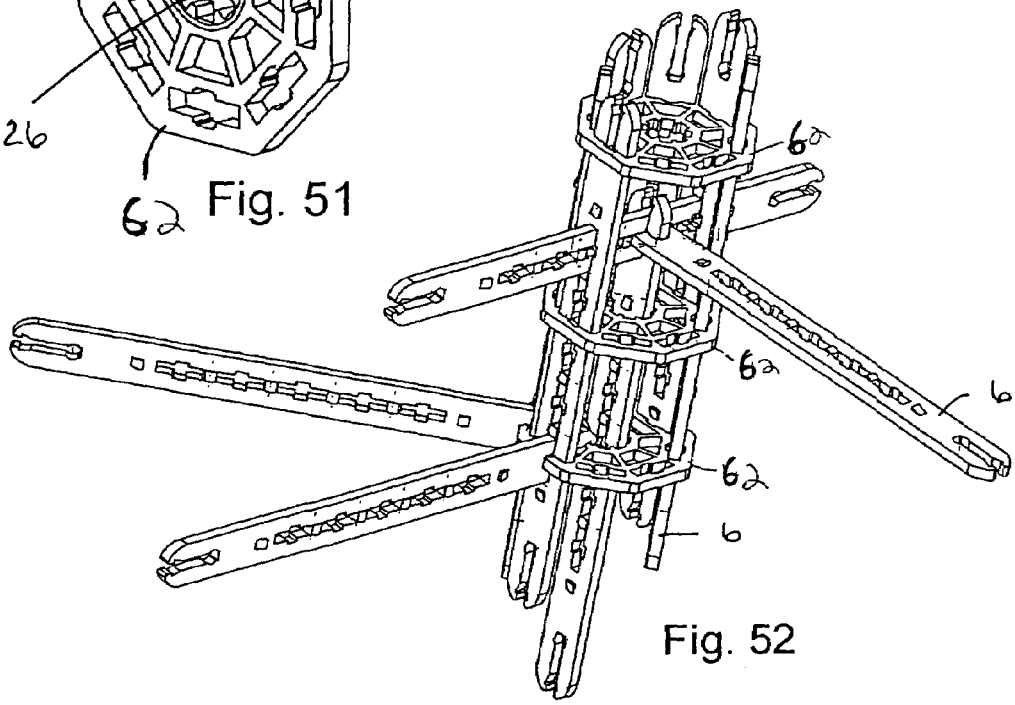
FIG. 52 shows a perspective view of three of the embodiments of FIG. 5 used in a building structure.

Turning our attention to FIG. 5 (and FIGS. 51 and 52), shown is another structural piece 62. This structural piece (a "hub") being generally octagonal with an angular orientation hole 26 in the center, surrounded by a number of locking slot connectors 38. These locking slot connectors for allowing one of the appendages of a structural piece of the present invention to be slid there through. Similar to the non-locking slot connectors 36 shown in FIG. 6, the locking slot connectors 38 are able to receive there through more easily appendages having locking ridges 24 thereon, whereas the non-locking slot connectors 36 are better configured for receiving there through appendages not having locking ridges thereon (such as those shown in FIG. 6). FIG. 52 shows one example of a use of such hubs 62 in conjunction with other structural pieces 76 to form an example building structure.

Figure 11:
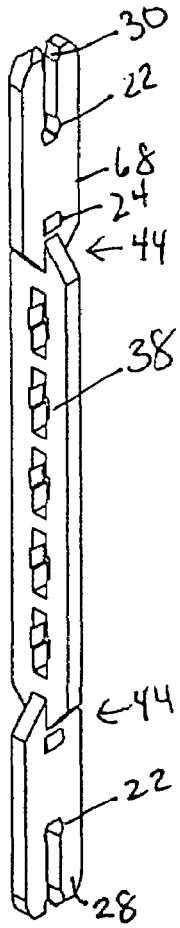
FIG. 11 shows a plan view of a tenth embodiment of a structural element of the present invention.
Figure 12:
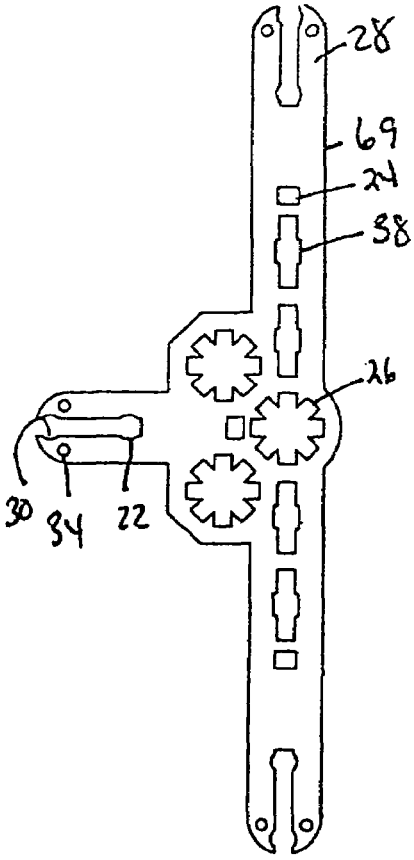
FIG. 12 shows a plan view of an eleventh embodiment of a structural element of the present invention.
Figure 13:
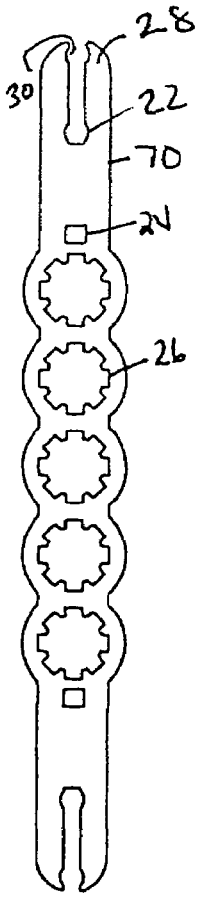
FIG. 13 shows a plan view of a twelfth embodiment of a structural element of the present invention.
Figure 14:
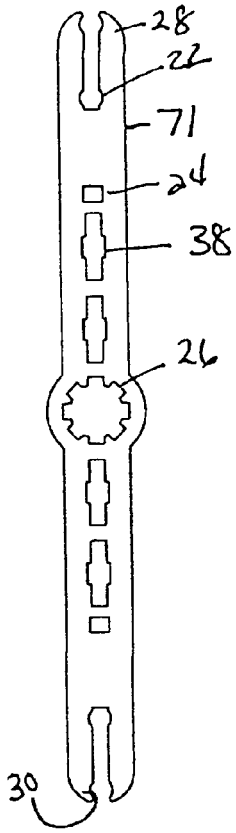
FIG. 14 shows a plan view of a thirteenth embodiment of a structural element of the present invention.

Referring now to FIG. 11, shown is a structural piece 68 showing the possibility of rotating a portion of the structural piece to allow for variations within the alignment of adjacent pieces and connections. For instance, in this case, the center portion of the structural piece 68 has been molded and/or turned at a 90-degree (perpendicular) angle to the two ends of the piece and includes a direction changer 44.

Figure 15:
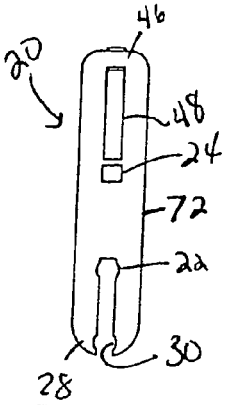
FIG. 15 shows a plan view of a fourteenth embodiment of a structural element of the present invention.
Figure 16:
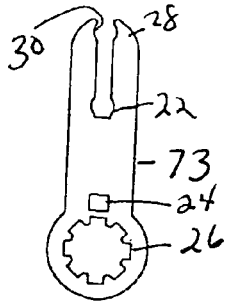
FIG. 16 shows a plan view of a fifteenth embodiment of a structural element of the present invention.
Figure 17:
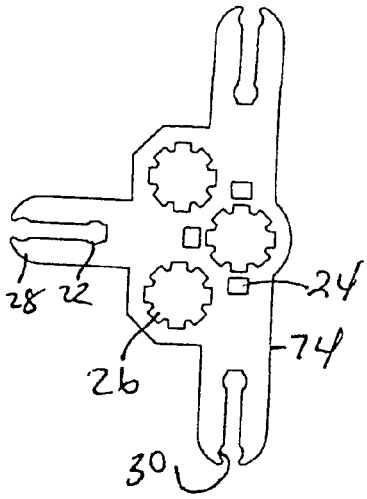
FIG. 17 shows a plan view of a sixteenth embodiment of a structural element of the present invention.
Figure 24:
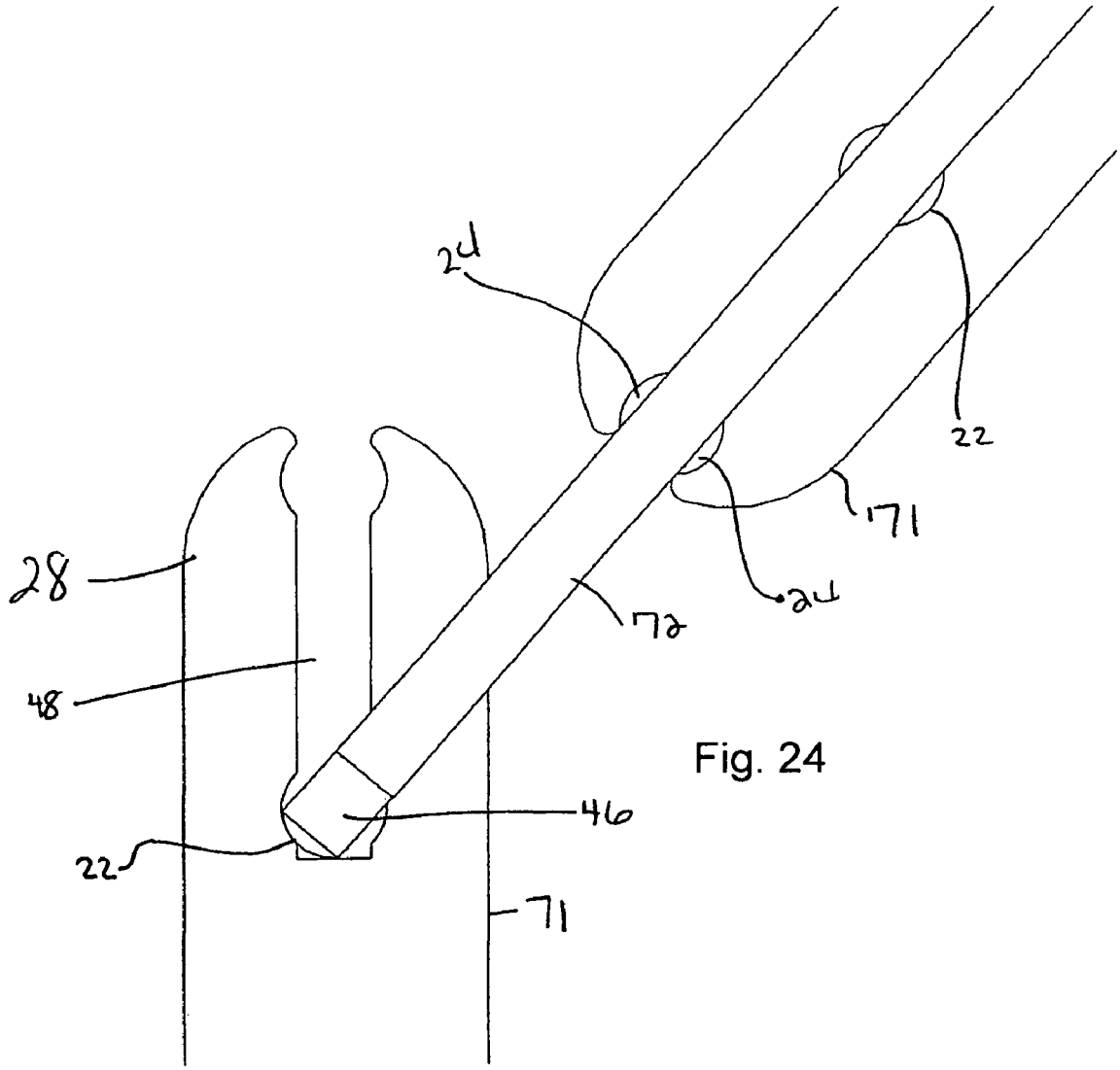
FIG. 24 is a partial, perspective view of another possible connection of the present invention.

Referring now to FIG. 15, shown is one embodiment of a structural piece 72 configured with a stirrup portion 20 used as a pivoting connector 80 (as shown in later drawings). The stirrup portion 20 has a pivot piece 46 and a pivot passageway 48. This pivot arm is further shown in drawing page 24. FIGS. 15 and 24 show a pivot arm structural piece 72, which has a pivot 46 and a pivot passageway 48 comprising the stirrup portion 20. This pivot arm 72 is configured for utilization with the pivot portion 22 of an adjacent structural piece. The pivot being slid into an adjacent structural piece's 71 key connector down to the portion of the key connector that comprises a pivot portion 22 with the different flanges of the key connector being able to slide through the pivot passageway 48. As such, the pivot 46 is allowed to rotate within the pivot portion 22 as shown in these drawings. This allows a pivoting connection to be made.

Figure 18:
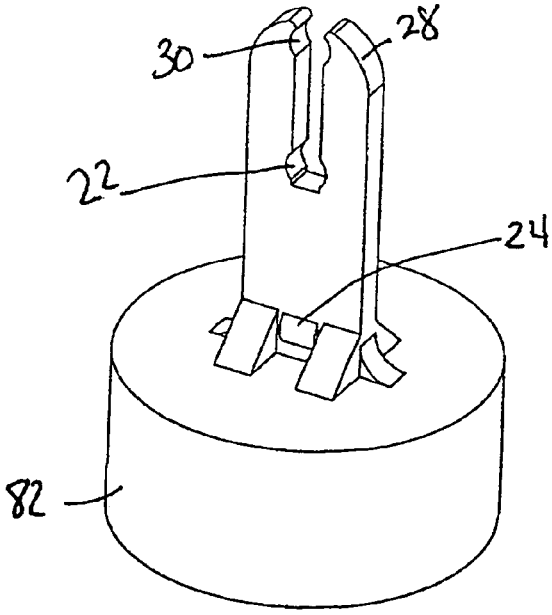
FIG. 18 shows a perspective view of a seventeenth embodiment of a structural element of the present invention.
Figure 19:
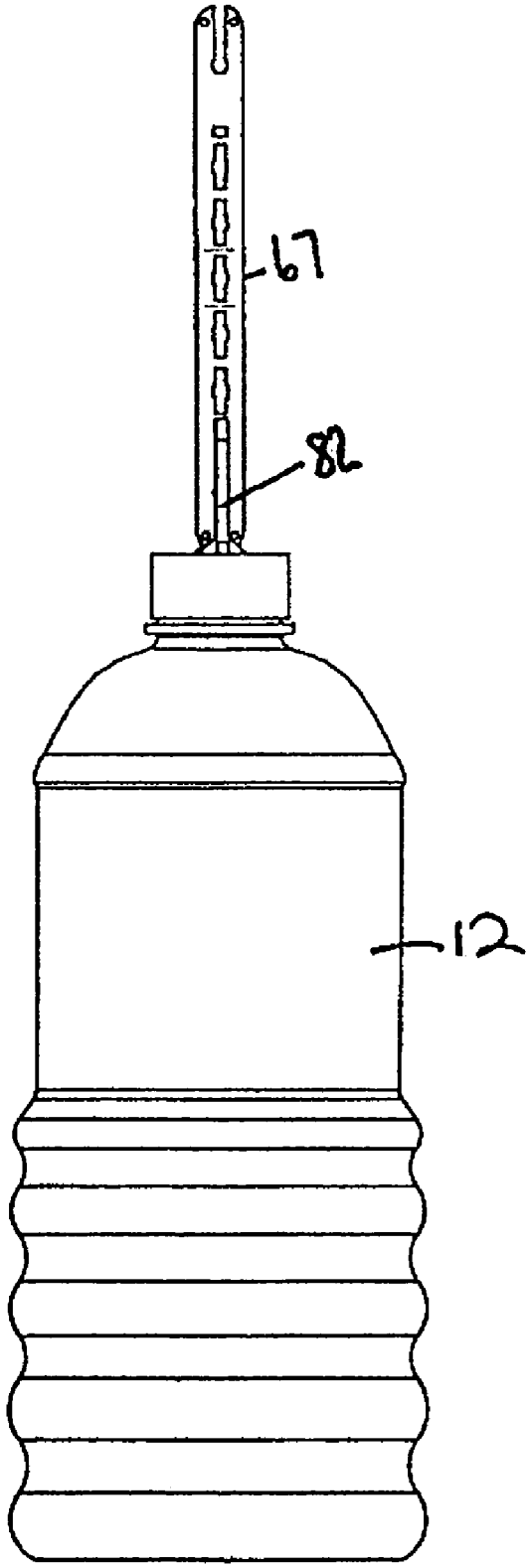
FIG. 19 shows an environmental view of the embodiment of FIG. 18.
Figure 81:
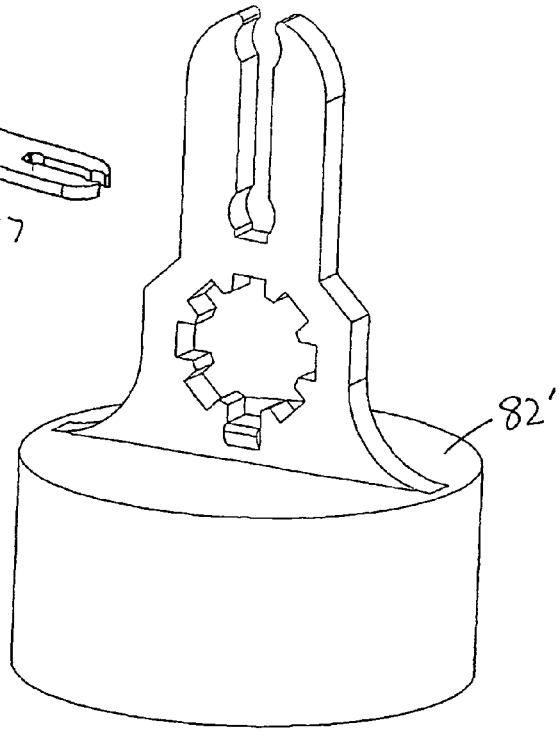
FIG. 81 shows a perspective view of a fifty-fourth embodiment of a structural element of the present invention.

Referring now to FIGS. 18 and 81, shown are two different embodiments of bottle connectors 82, 82' of the present invention. Such a bottle connector configured with internal threads for screwing onto a typical drinking water or soda bottle. This allows the present invention to be utilized with such a bottle, this bottle (if empty) either provides buoyancy or if filled provides weight to the present invention as used in various configurations. Shown extending from the top of the bottle connection in this case is a connector for allowing this piece to be connected with various components of the present invention. Obviously, it is also envisioned that this connector piece could be configured for connecting with and being utilized with other types of construction sets on the market today including, but not limited to Tinker Toys®, Legos® (i.e, FIG. 29), K'NEX®, etc, such a bottle connector is configured for use with those systems and is envisioned as part of this present invention. FIG. 19 shows the connection of one embodiment of such a bottle connection 82 between a water bottle 12 and a structural piece 67.

Figure 20:
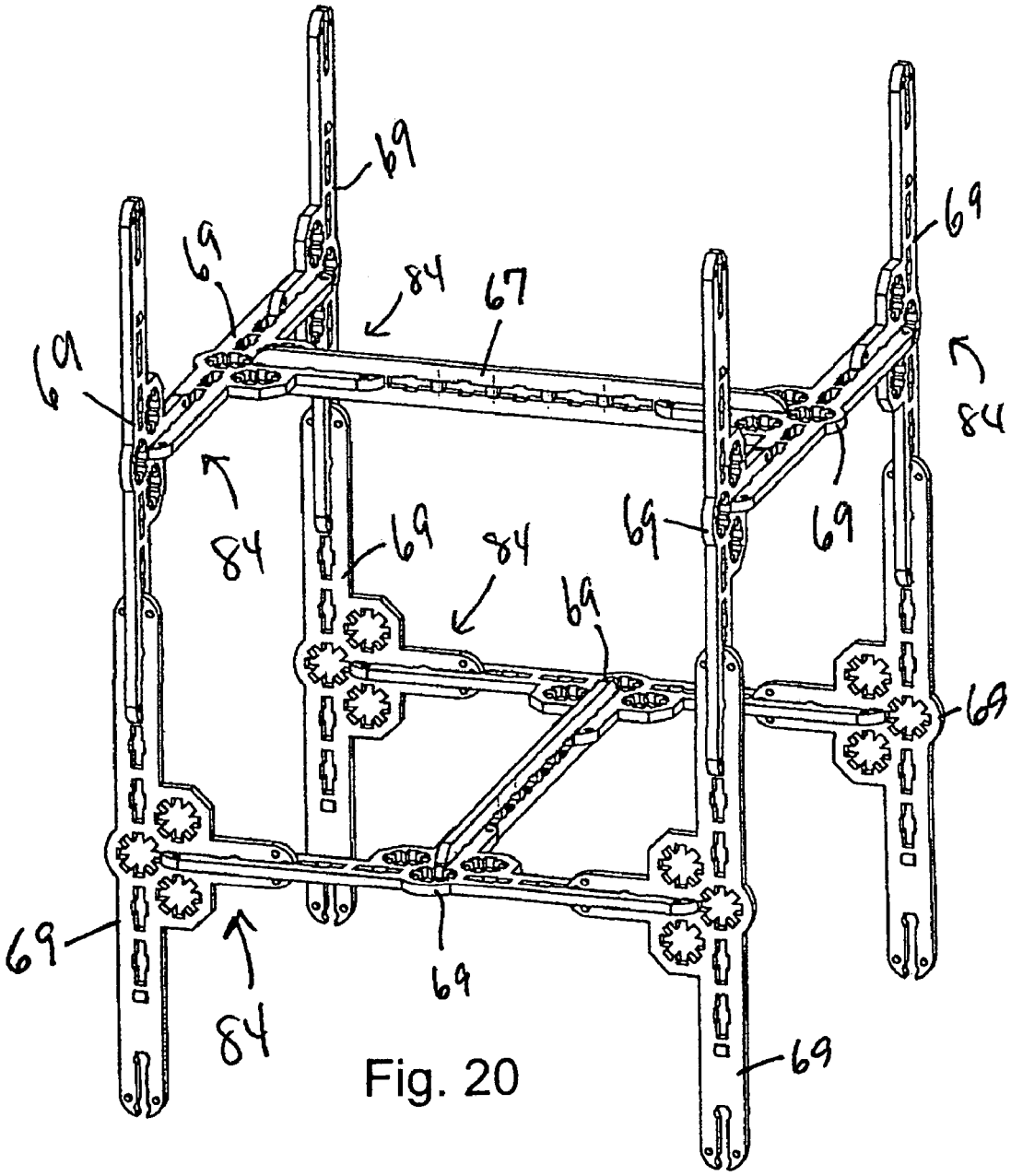
FIG. 20 is a perspective view of one example of a structure built using the present invention.

Referring now to FIG. 20, shown is one representation of how structural elements of the present invention could come together to form a construction structure. This figure shows various manners connecting the present invention together and is not intended as being a limitation but is just done for further explanation. This figure shows a connection of a number of different structural pieces 69 with a number of different structural pieces 67 to create a building system. The present invention's key-to-key style connection 84 is used to lock these various components together.

Likewise, as shown FIG. 21, key to key connections 84 are used to join various components together (in this case, structural pieces 60 to one another and structural pieces 60 to structural piece 67 to form the general structure shown.

Figure 22:
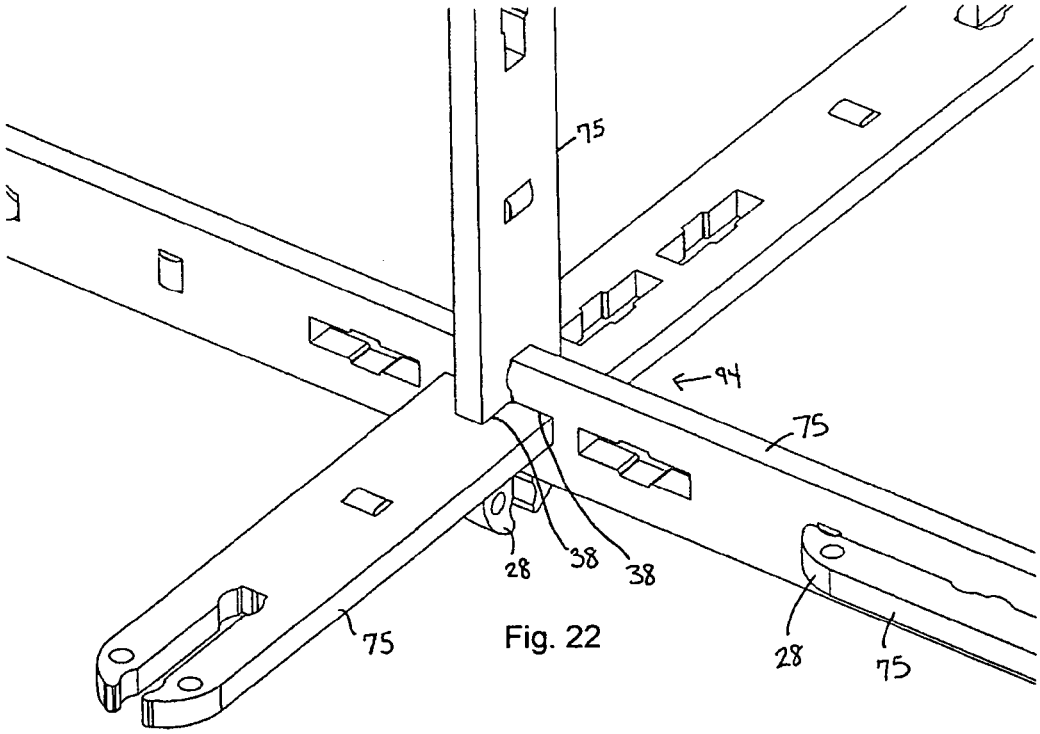
FIG. 22 is a partial, perspective view of some of the possible connections of the present invention.

Referring now to FIG. 22, shown is one embodiment of aligned slots locked with a key style connector 94. In this drawing, shown are a plurality of structural pieces 75, the first structural piece 75 slid through one of the locking slot connectors 38 to a point where it aligns with an adjacent locking slot connector 38 of the other structural piece. A third structural piece 75 has its key connector portion 28 snapped there over thereby locking the three different structural pieces together.

Figure 23:
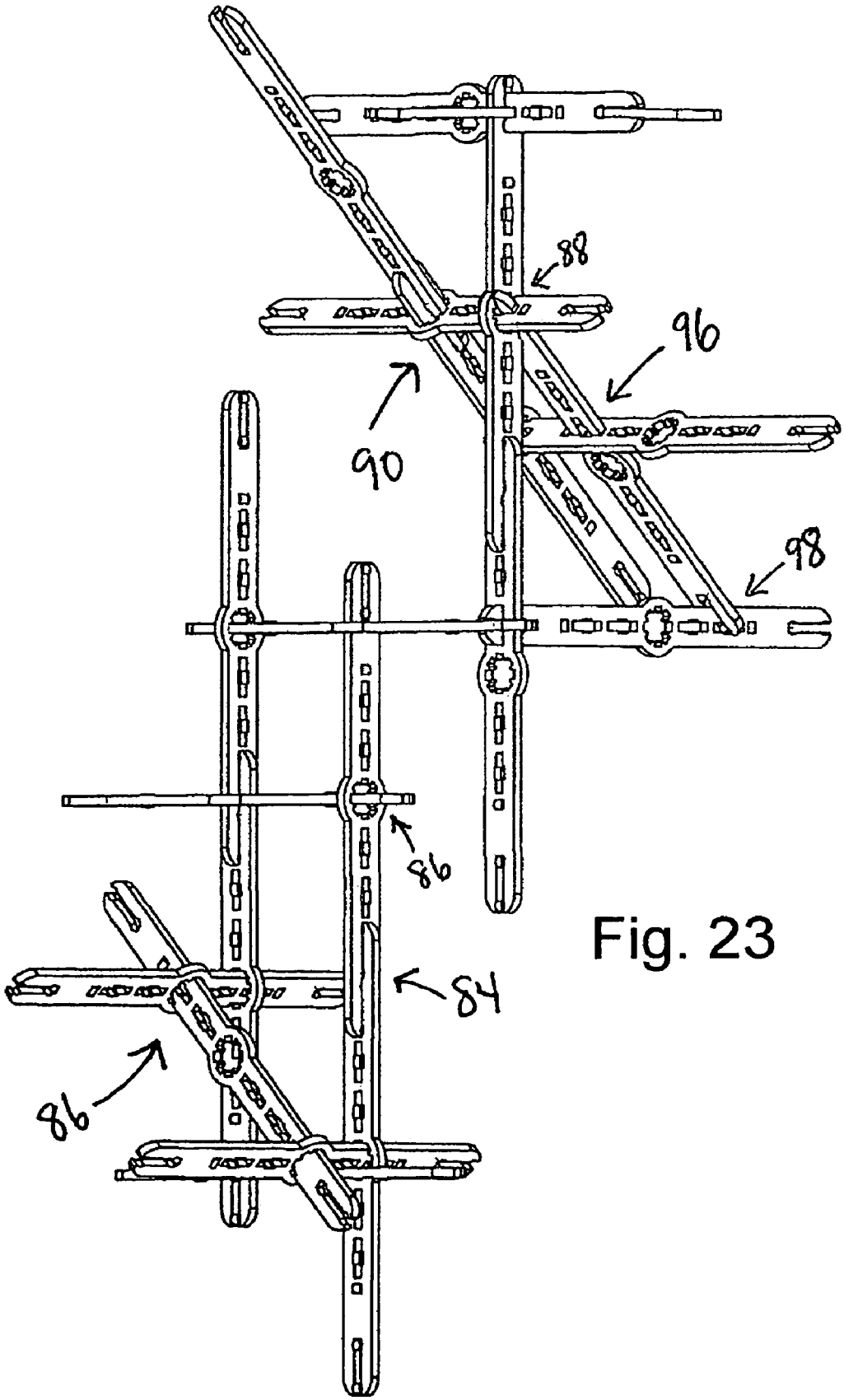
FIG. 23 is a perspective view of one example of a structure built using the present invention.
Figure 25:
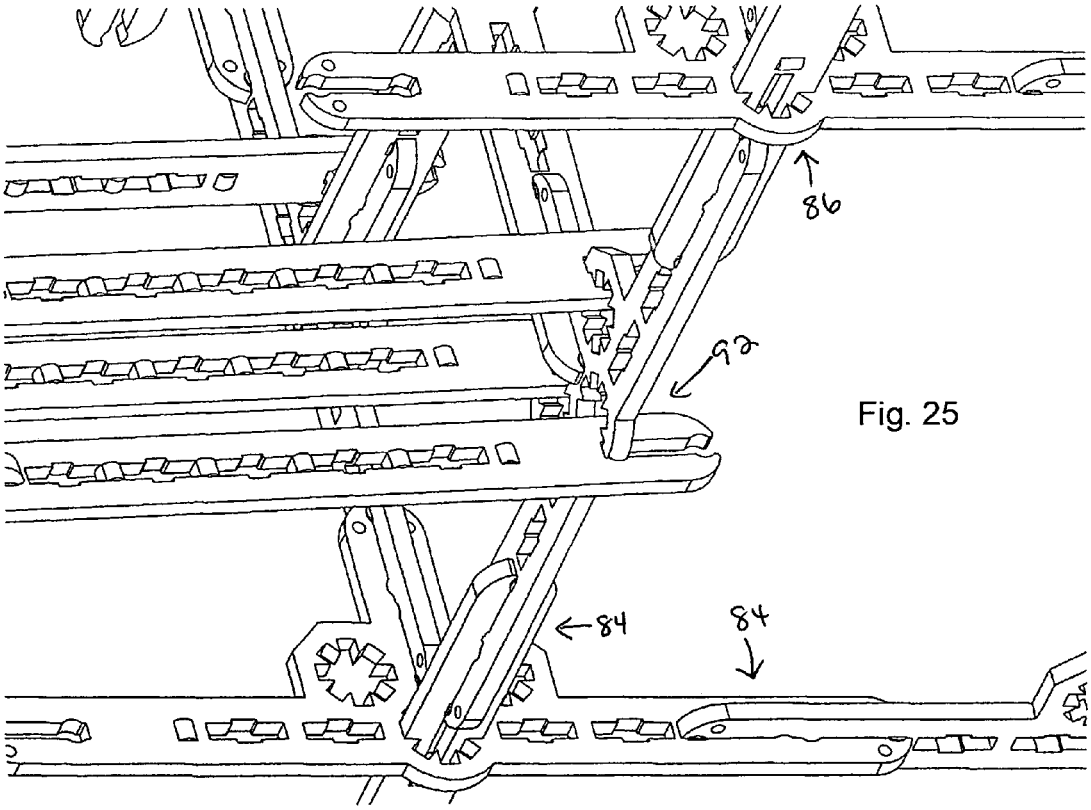
FIG. 25 is a partial, perspective view of some of the possible connections of the present invention.

Referring now to FIG. 23, shown is the ability to utilize the angular orientation hole 26 to allow structural pieces to connect together. For instance, a key to key style connection 84 can be further slid through an angular orientation hole 26 to form the key to key thru star style connection 90. Also shown is a stick thru star connection 86, a stick thru slot connection 96 and a key slid over the side of stick connection 98. Obviously the types of connections disclosed herein are merely a sampling of the different types of connections that can be made. FIG. 25 shows another close-up of some connections, including key-to-key connections 84, half key thru star connections 92, and stick thru star connections 86.

Figure 26:
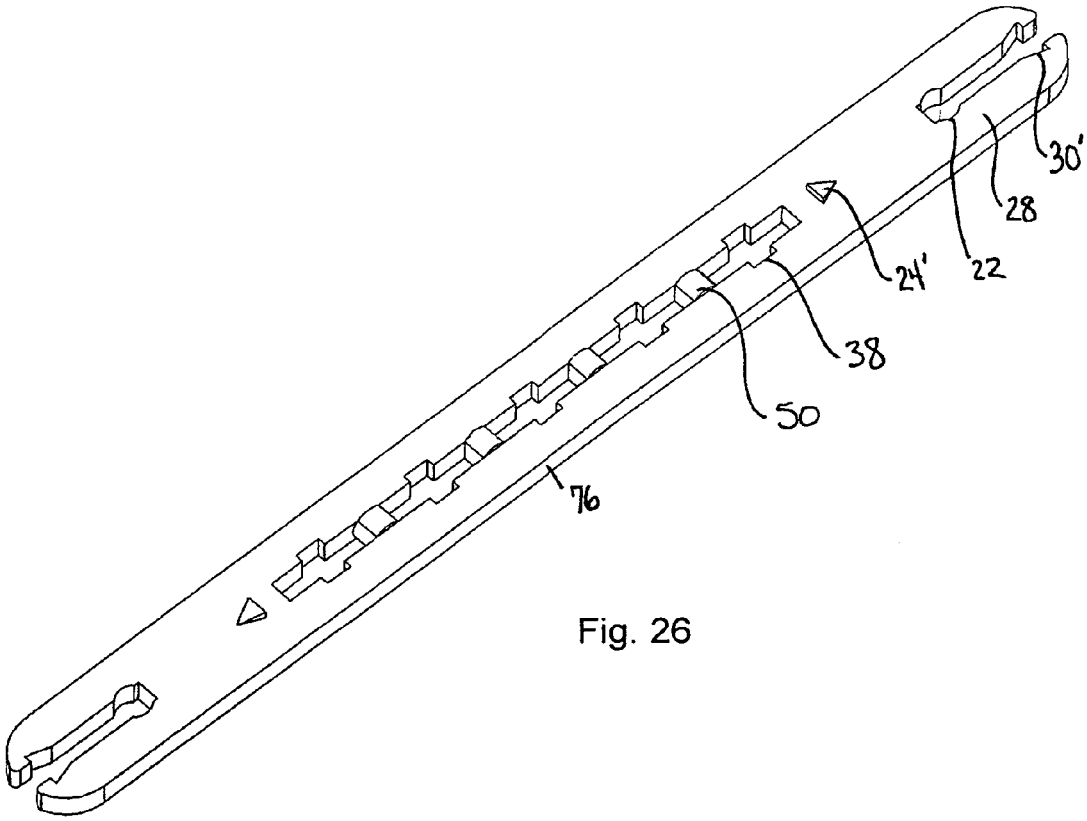
FIG. 26 shows a plan view of an eighteenth embodiment of a structural element of the present invention.

Referring now to FIG. 26, shown is another embodiment of a structural piece 76 of the present invention. This structural piece has a pair of ends with each end having a key connector 28, having a pivot portion 22, a key connector locking portion 30' and a locking ridge 24'. In this embodiment, the key connector locking portion 30' and the locking ridge 24' are configured differently than what has been shown before, these embodiments show a generally triangular pyramidal shaped locking ridge 24' and a generally triangular shaped mating key connection locking portion. Such a combination locking ridge and locking portion allow for the key connector to lock more rigidly upon the mating structural piece. While this shows one particular embodiment of such an alternative lock, obviously any additional shape or other associated locking portion is likewise envisioned. In the preferred version of this embodiment, in attaching to adjacent structural pieces, either/or the end of the key connector could be forced forward, riding up on the slope of the locking ridge 24' snaps within the key connector 30' (of an adjacent structural piece) or the key connector could be slightly bent and advanced forward and then unbent to slide behind the far end of the locking ridge thereby allowing the structural pieces to be connected together without necessitating the key connector riding over the locking ridge and locking thereon.

Figure 27:
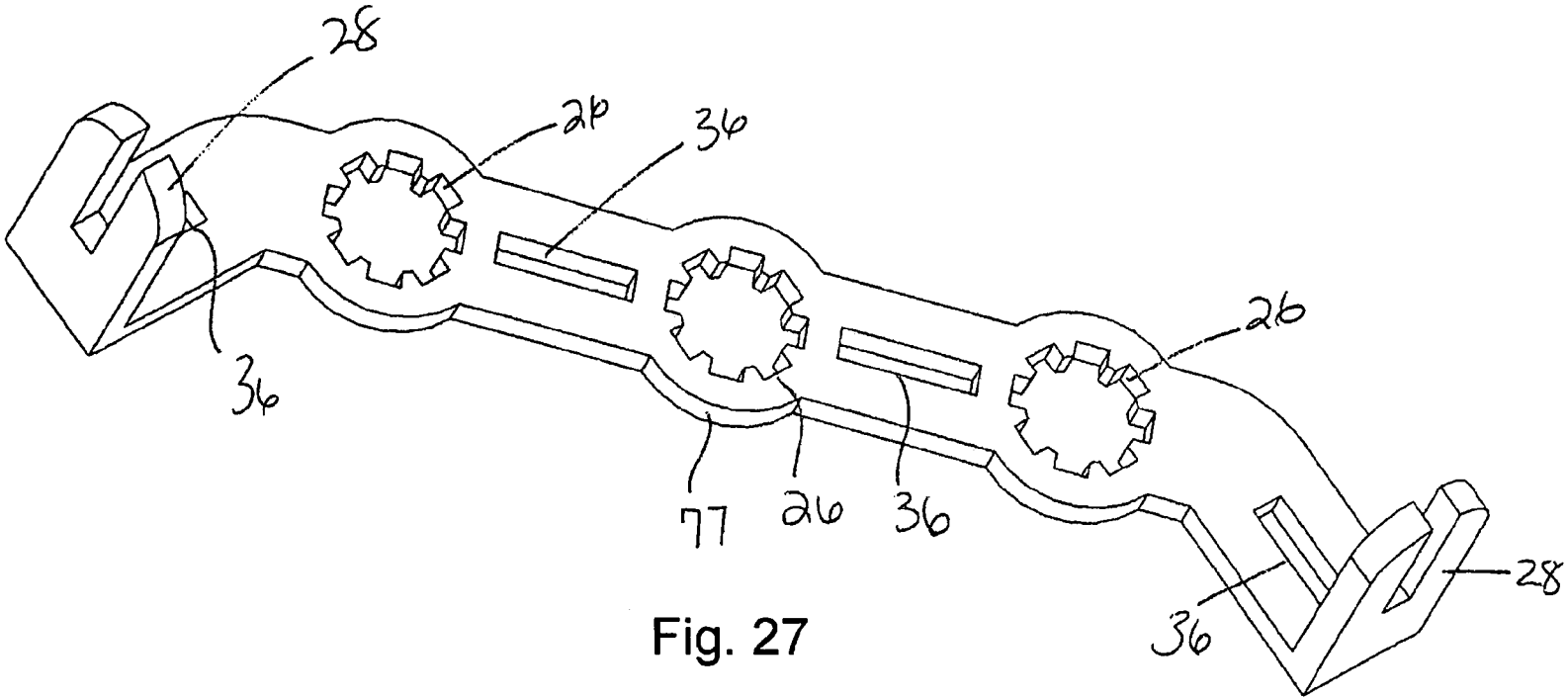
FIG. 27 shows a plan view of a nineteenth embodiment of a structural element of the present invention.

Referring now to FIG. 27, shown is one embodiment of another structural piece 77. This structural piece forms a brace unit or other use. This embodiment shows that the ends of the structural piece have been both turned generally 45 degrees relative to the main portion of the body of the structural piece 77 and also have their ends turned away therefrom generally 90 degrees thereby forming the shape shown.

Figure 28:
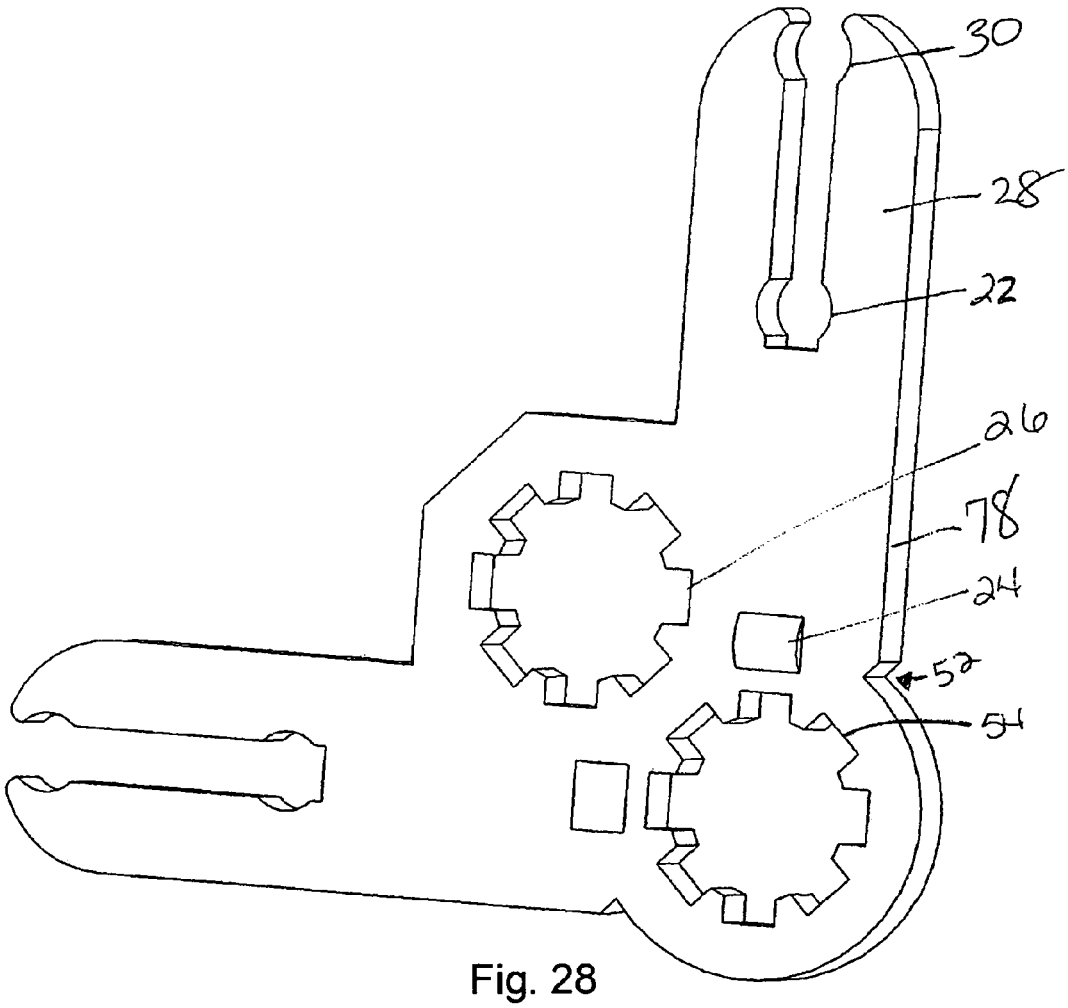
FIG. 28 shows a plan view of a twentieth embodiment of a structural element of the present invention.

Referring now to FIG. 28, shown is another structural piece 78 which has a locking ridge 24, a key connector 28, a key connector locking portion 30, an angular orientation hole 26 and a pivot portion 22. This embodiment further shows a couple of new concepts, the first one is a notch 52 within the side of the structural piece 78, this notch allows the adjacent groove 54 to be accessible to a connector. For instance, a one half key thru star connector 92 as previously shown.

Referring now to drawing page 29, shown is an additional embodiment of the bottle connector previously disclosed. This bottle connector 32' having a bottle connector body 32' with this body having preferably therein a plurality of threads of threading 33 for allowing the bottle connector 32' to be screwed on to a standard water bottle, milk jug, etc. This bottle connector 32' connecting with a block style connector 81 thereby allowing the present invention to be utilized with locking blocks and the like. Again, as an embodiment of the present invention it can include the combination of any kind of bottle connector with a specially formed connector for connecting with a building set of other structures, including but not limited to taking a bottle connector connecting thereto a Lego piece, a K'NEX® piece, a Tinker Toys® piece, etc. This style connector being a bottle connection 82' for connecting a bottle such as a water bottle, to a toy construction set.

Figure 30:
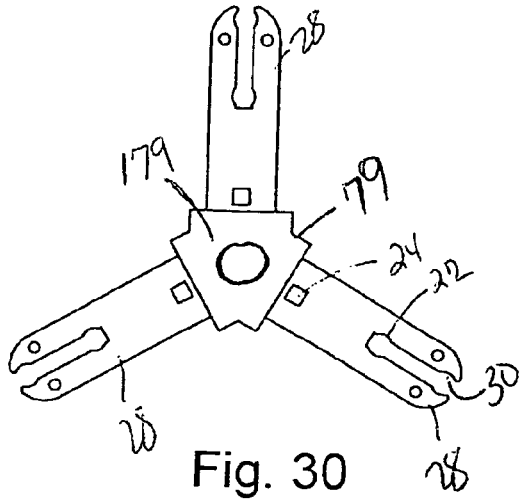
FIG. 30 shows a plan view of a twenty-second embodiment of a structural element of the present invention.
Figure 31:
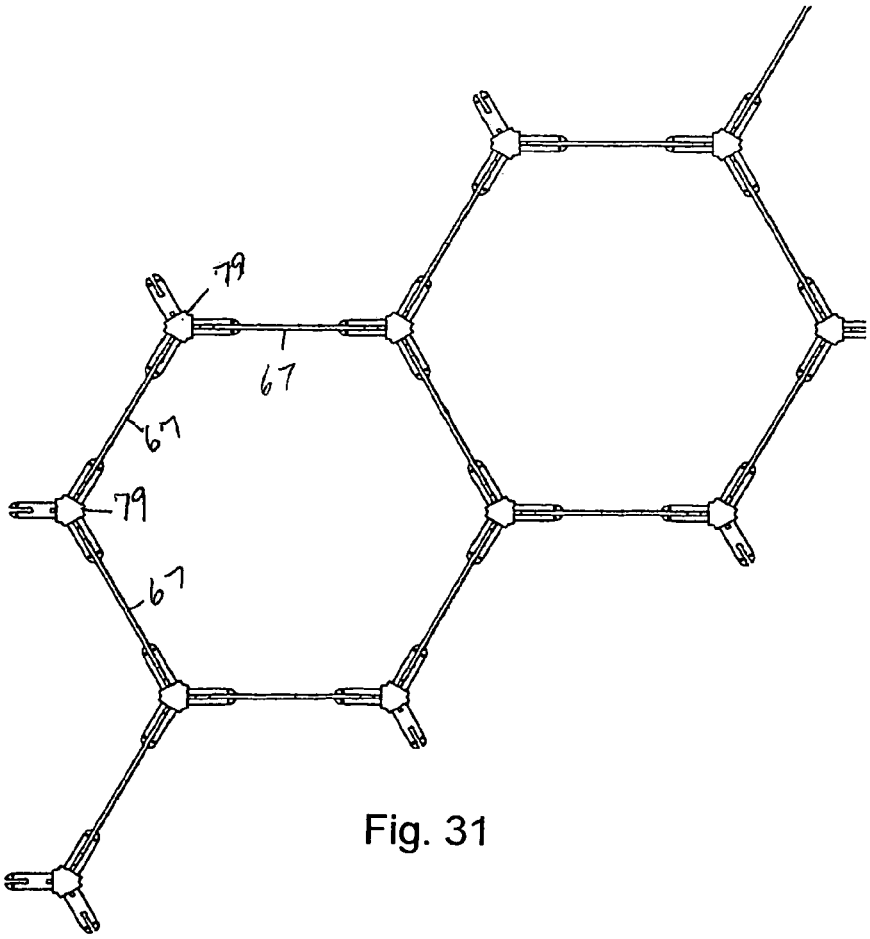
FIG. 31 is a partial, plan view of some of the possible connections of the present invention.
Figure 32:
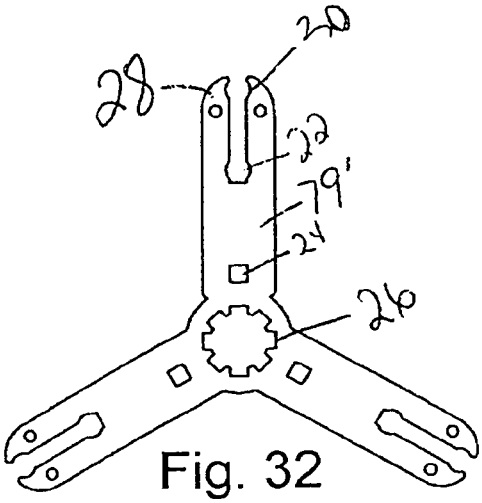
FIG. 32 shows a plan view of a twenty-third embodiment of a structural element of the present invention.

Referring now to FIGS. 30, 31 and 32, shown are various embodiments of two additional structural pieces (79, 79'). These embodiments show a generally triangular shaped piece having three key connectors extending therefrom. Previously, it was discussed the possibility of making a flexible portion at other portions of the structural piece. As such it is envisioned that such a flexible portion could be configured with any portion of the structural piece. In the embodiment shown, this flexible portion 179 forms the center junction between the various arms or key connectors 28 of the embodiment. Because such an embodiment has some flex to it, a structure as shown in FIG. 31 could be formed of these structural piece 79's and other structural pieces (in example, a structural piece 67) that would allow joints to be flexible. Such a type of structure as shown in FIG. 31 (with additional components) could be used to form a geodesic dome shaped structure, a spherical structure or other such structures.

Referring particularly to FIG. 32, shown is a fixed design of a tertiary arrangement. This fixed design of a structural piece 79' has a pivot portion 22, a locking ridge 24, a key connector 28, a key connector locking portion 30 and an angular orientation hole 26.

Figure 33:
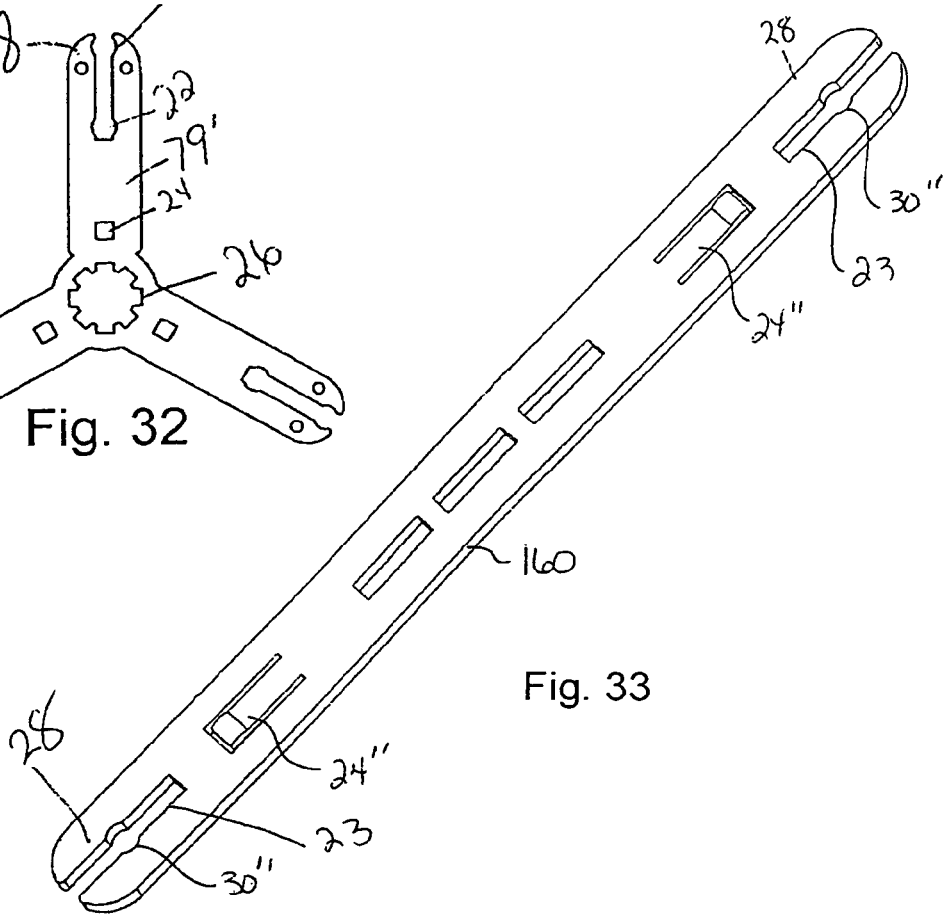
FIG. 33 shows a plan view of a twenty-fourth embodiment of a structural element of the present invention.

Referring now to FIG. 33, shown is another embodiment of the structural piece 160. This embodiment of the structural piece shows an alterative configuration for a locking ridge 24" in cooperation with a key connector locking portion 30". This embodiment shows that there are many different configurations that can be made to this concept of a combination locking ridge and key connector locking portion. In the embodiment shown, the key connector locking portion 30" can additionally serve as a pivot portion. In the embodiment shown, the locking ridge 22 extends from a living spring that as the opposing connector is slid therein the locking ridge at the end of the living spring is able to pop within the key connector locking portion thereby locking the two structural pieces together. Removal of the disconnection of the two structural pieces could be accomplished through either depression of the living spring thereby generally removing the locking ridge from the locking portion, or through bending sideways the key connector 28 so that the locking ridge 24 comes out of the locking portion 30.

Figure 34:
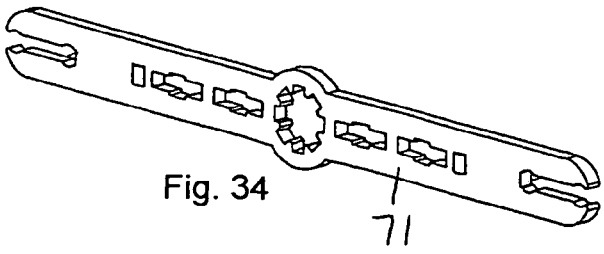
FIG. 34 shows a plan view of a twenty-fifth embodiment of a structural element of the present invention.
Figure 35:
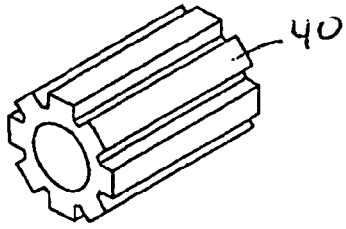
FIG. 35 shows another perspective view of the embodiment of FIG. 3.
Figure 36:
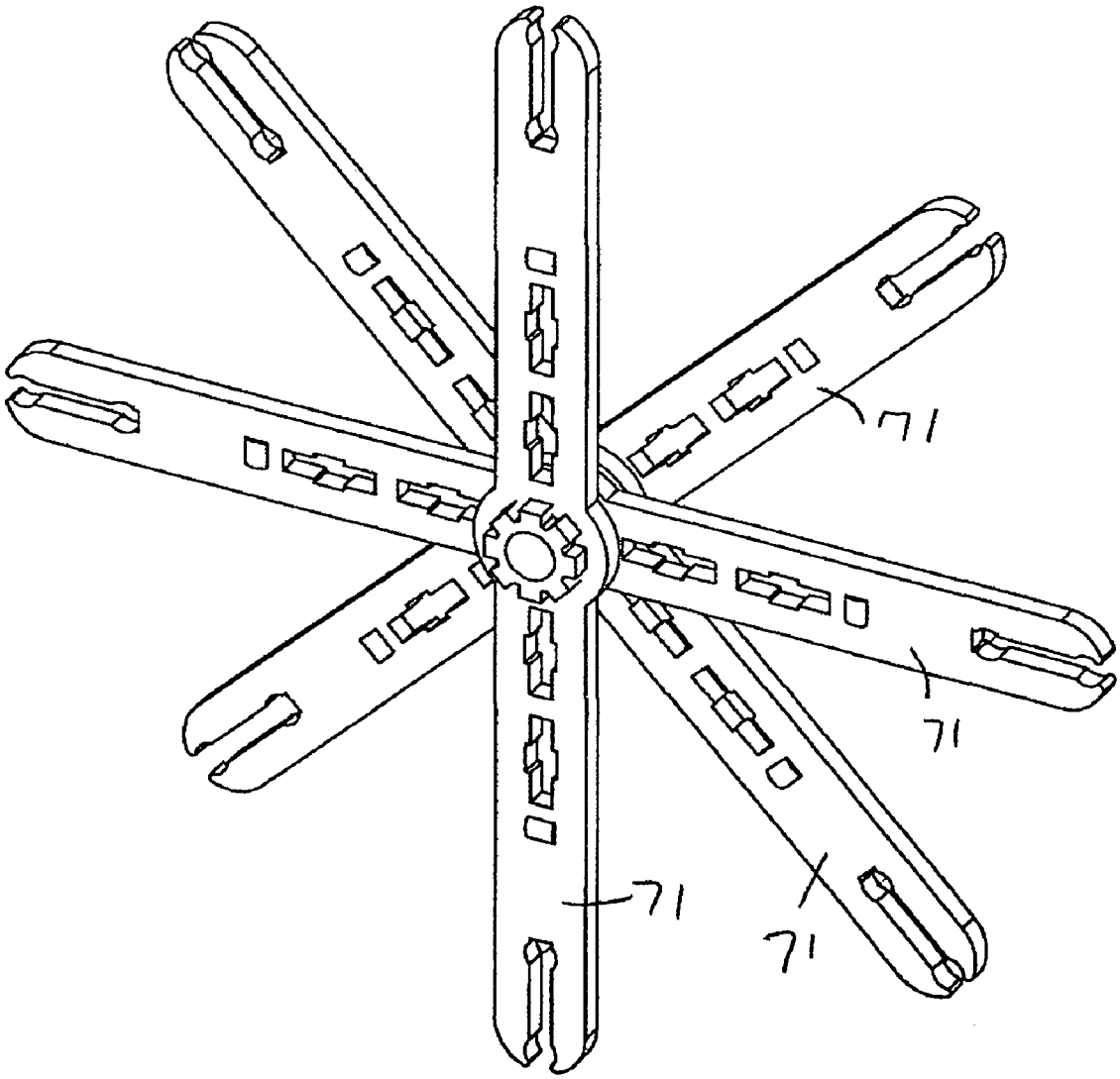
FIG. 36 is a perspective view of some of the possible connections of the present invention.

FIGS. 34, 35 and 36 shown another embodiment of a structural piece construction utilizing a star cylinder connector 40 as discussed above. This star cylinder 40 can be any length, having ridges, bumps and/or grooves to allow for snap fit. It can have a center hole to accommodate an axle or other connector. FIG. 34 shows one such structural piece 71 that can be used therewith, this structural piece having an angular orientation hole as discussed above. FIG. 36 shows the utilization of one of such cylinder connectors 40 to connect a plurality of structural pieces 71 together.

Figure 37:
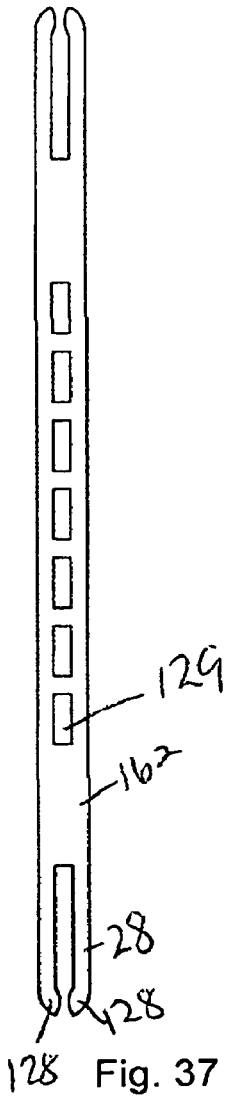
FIG. 37 shows a plan view of a fifth embodiment of a structural element of the present invention.
Figure 38:
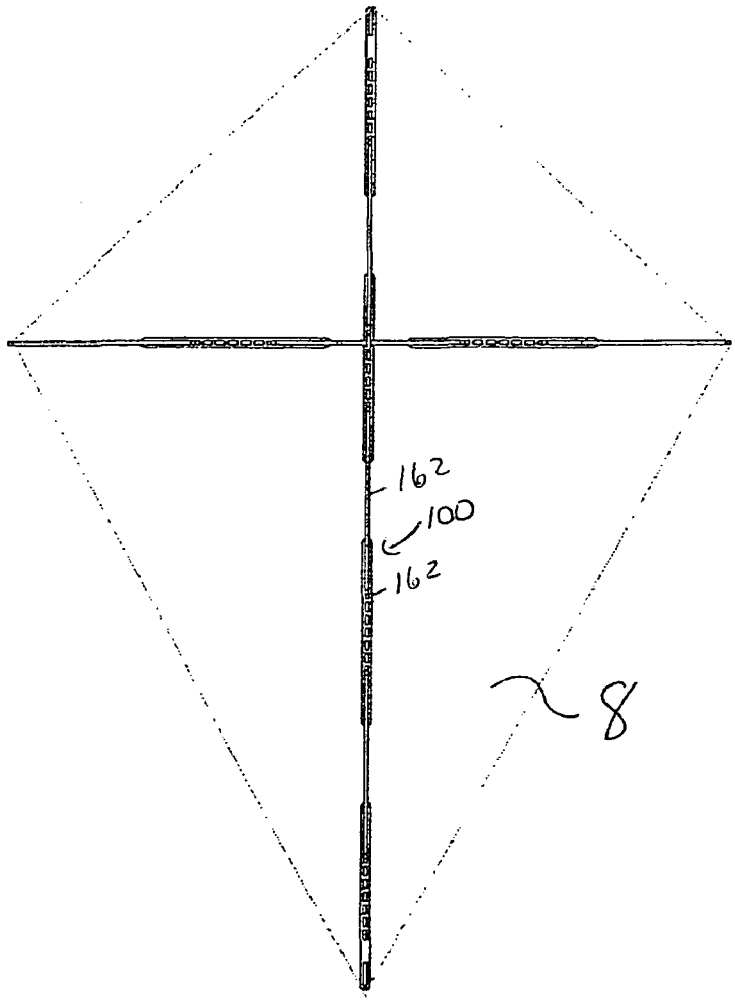
FIG. 38 shows a kite made from structural elements of the present invention.

Referring now to FIGS. 37 and 38, shown is another structural piece 162 of the present invention. Units of this structural piece are configured for attaching together so that the tips 128 of the key connector 28 are able to pop within the connection hole 129 of the structural piece connected thereto. This results in yet another type of connection, the tips through hole connection 100. FIG. 38 shows one embodiment of a kite 8 that could be made using such interlocking connectors and fabric.

Figure 39:
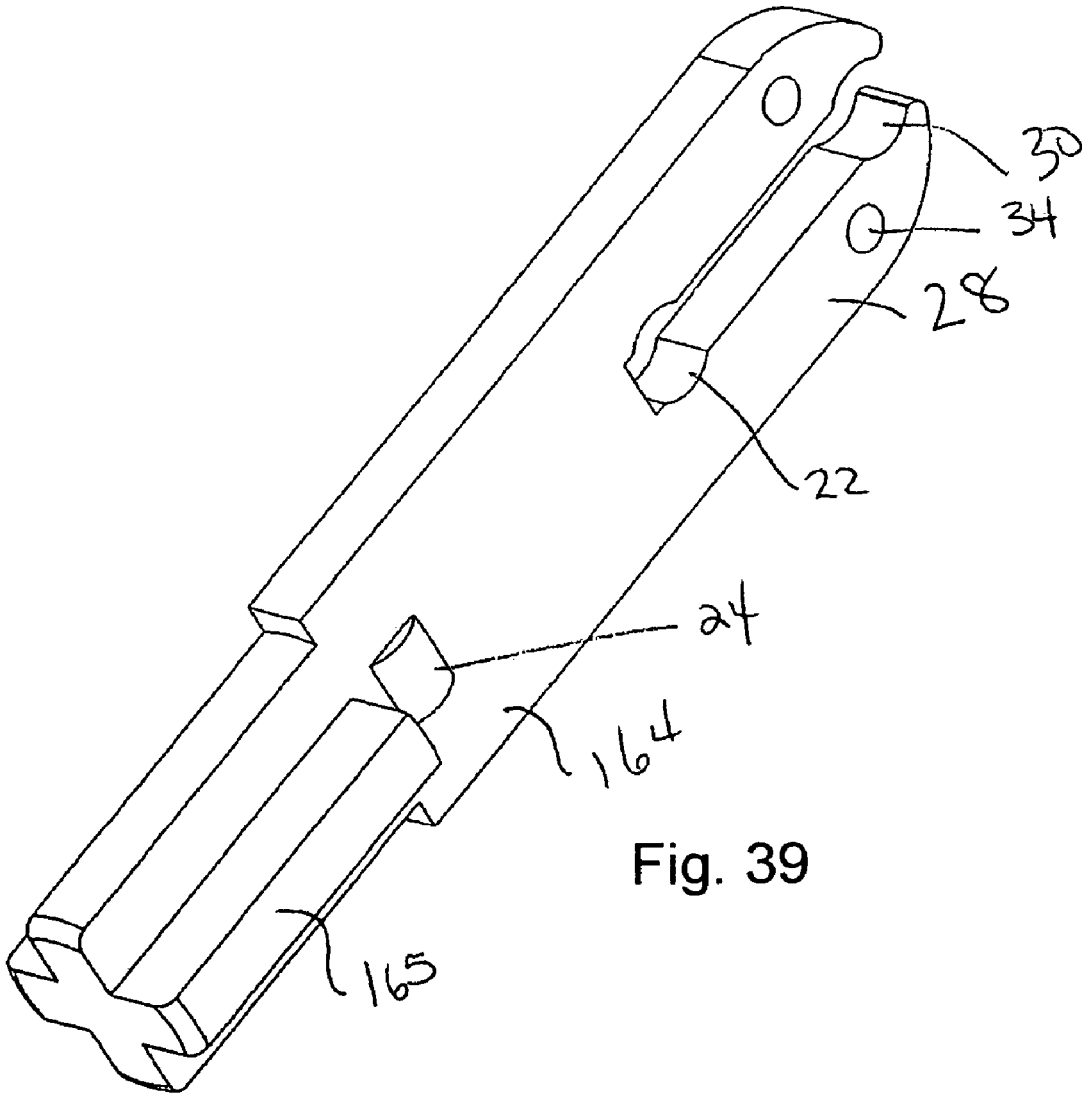
FIG. 39 shows a perspective view of a twenty-sixth embodiment of a structural element of the present invention.

FIG. 39 shows one embodiment of a structural piece 164 used to join a drinking straw with the present invention. This embodiment shows a straw connector 165 that is configured for receiving thereon the open end of a drinking straw. While this embodiment shows a generally X shaped connector, obviously other types of connectors could likewise be configured. This structural pieces further has a pivot portion 22, a locking ridge 24 that is configured for working with an adjacent (on another piece) key connector locking portion 30 and a key connector 28.

Figure 40:
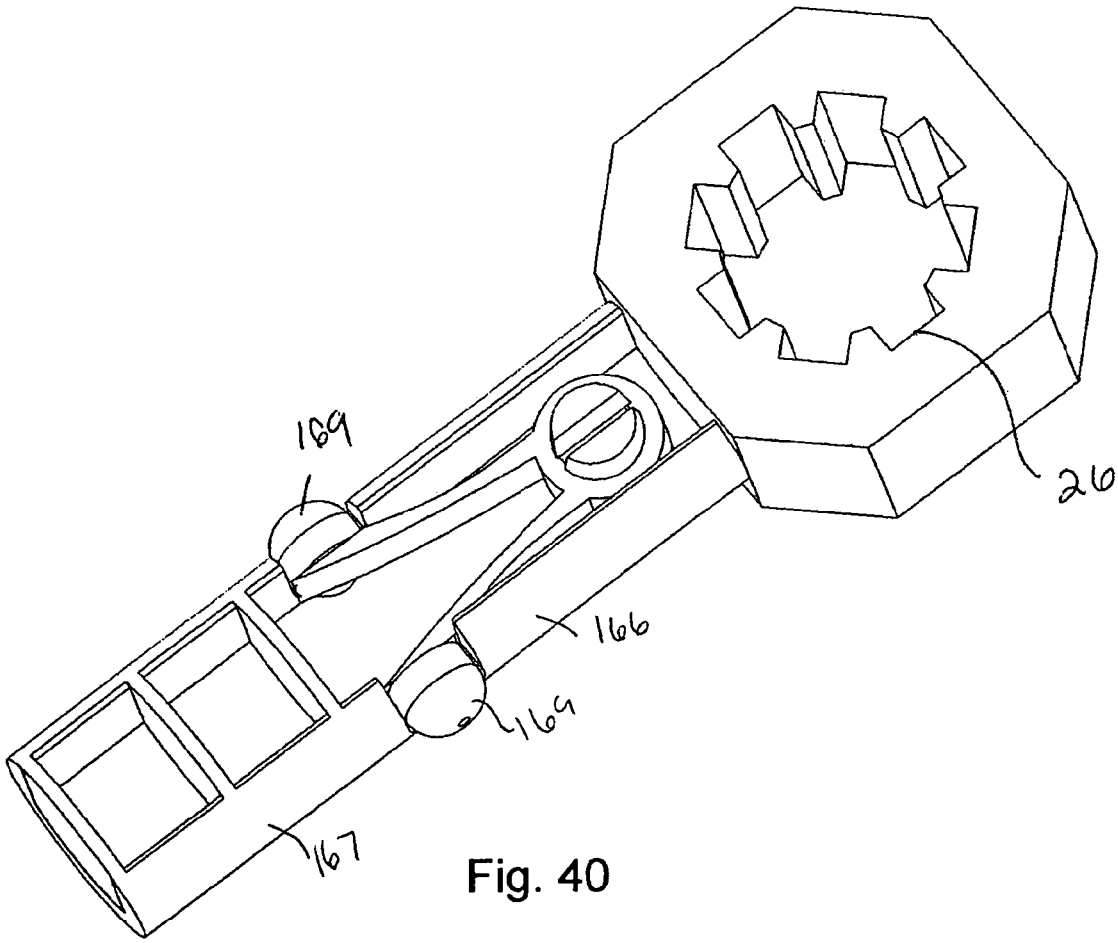
FIG. 40 shows a perspective view of a twenty-seventh embodiment of a structural element of the present invention.

Referring now to FIG. 40, shown is one embodiment of a straw connector structural piece 166. This structural piece 166 has a straw connector 167 for receiving thereon the end of a drinking straw. This straw connector further has at least one detent 169 thereon (preferably spring loaded) for cooperating with a hole punched within the sidewall of said straw (for instance using a paper hole punch). This structural piece 166 is shown having a body defined therein at an angular orientation hole 26. As with this piece and any other of the other pieces disclosed herein, obviously various components can be combined and modified as necessary, for instance rather than having an angular orientation hole 26 therein within the body, other components could be used.

Figure 41:
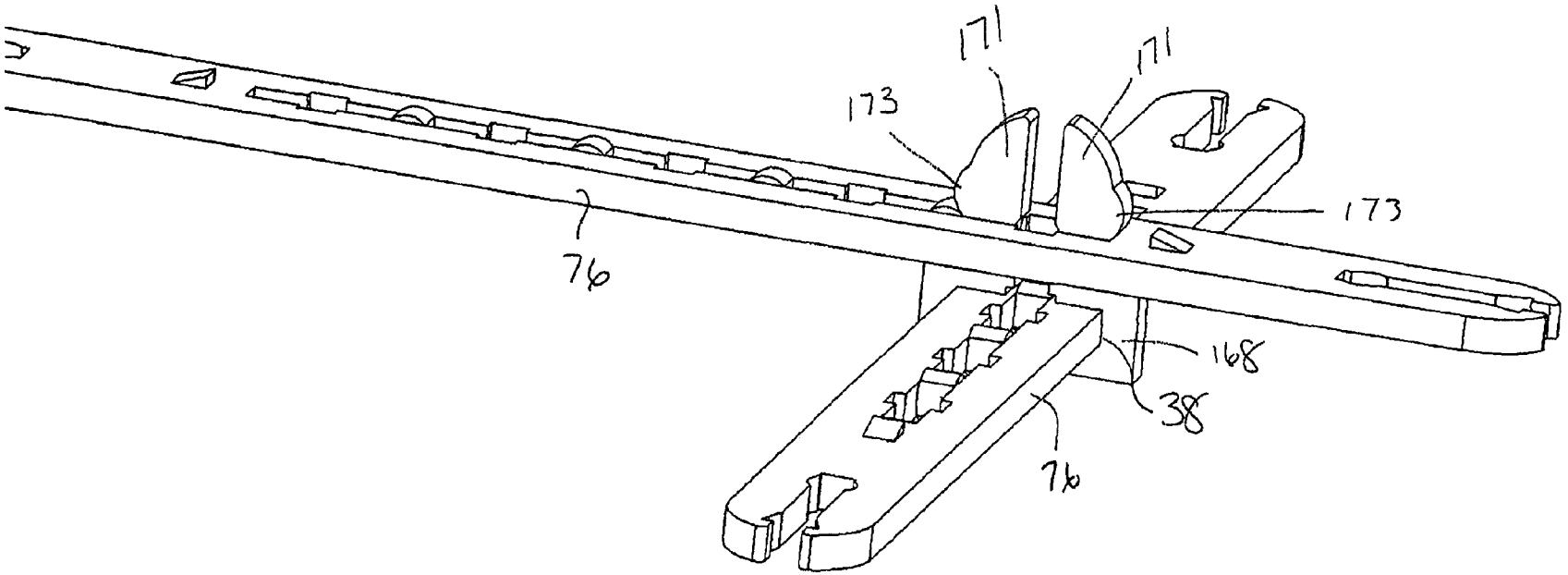
FIG. 41 shows a partial, perspective view of some of the possible connections of the present invention.
Figure 42:
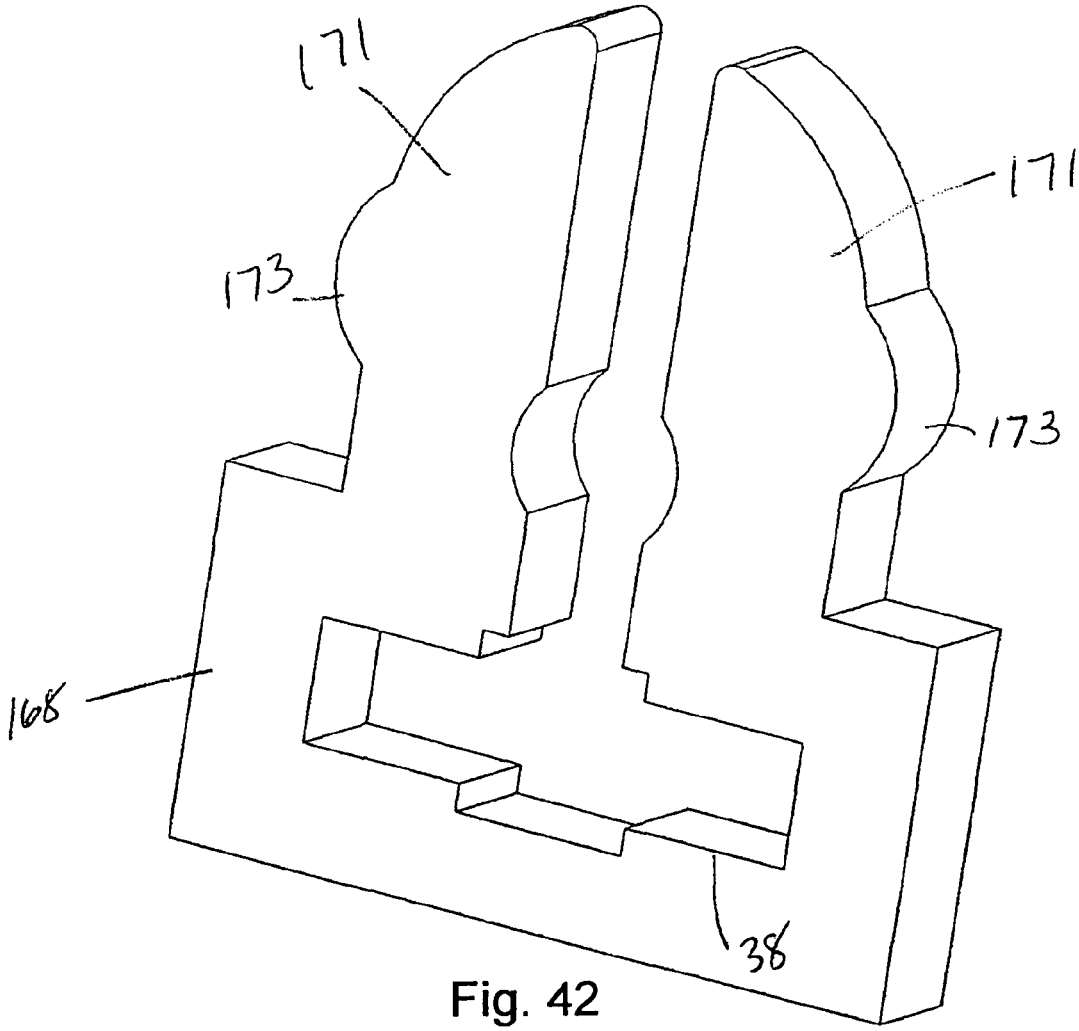
FIG. 42 shows a perspective view of a twenty-eighth embodiment of a structural element of the present invention.

Referring now to FIGS. 41 and 42, shown is one embodiment of a structural locking piece 168 of the present invention. The piece itself particularly shown in FIG. 42, wherein the piece has a pair of locking flanges 171 extending therefrom and a slot connector 38 defined there through. As such the flanges 171 could be pressed through a slot connector or other such holes in an adjacent structural piece (as shown in FIG. 41). The flanges are compressed together as it is inserted there through, but once insertion is complete the flanges spring back outwards thereby locking the piece thereon. This locking can be further assisted through sliding an additional structural piece through the slot connector thereby eliminating the ability of the two flanges to flex towards one another. Preferably a pair of extensions 73 is further used to lock the structural piece thereupon.

Figure 43:
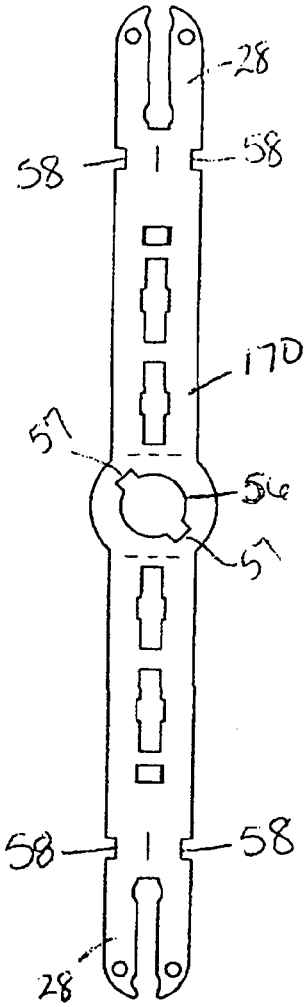
FIG. 43 shows a perspective view of a twenty-ninth embodiment of a structural element of the present invention.
Figure 44:
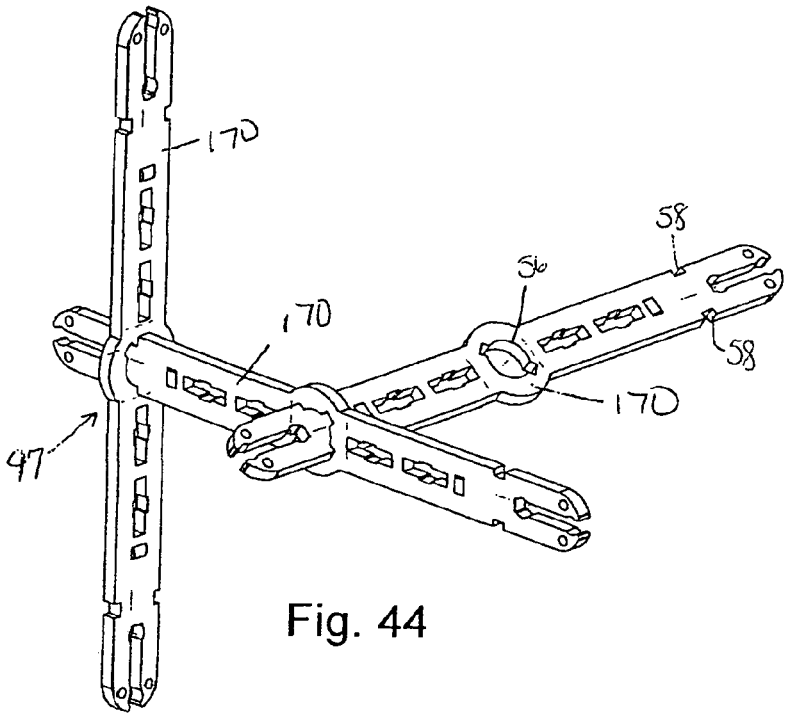
FIG. 44 shows a perspective view of a possible structural configuration built using the present invention.

Referring now to FIGS. 43 and 44, shown are an additional configuration of a structural piece 170 of the present invention. This embodiment utilizes at least one twist lock groove 56 and the twist lock groove 56 having at least one slot 57 wherein a mating structural piece 170 can be inserted. When the adjacent structural piece has aligning twist lock channels 58, upon aligning the twist lock channels with the twist lock groove the structural piece inserted can be rotated thereby locking the structural piece upon the adjacent structural piece as shown in the twist lock connection 97 of FIG. 44.

Figure 45:
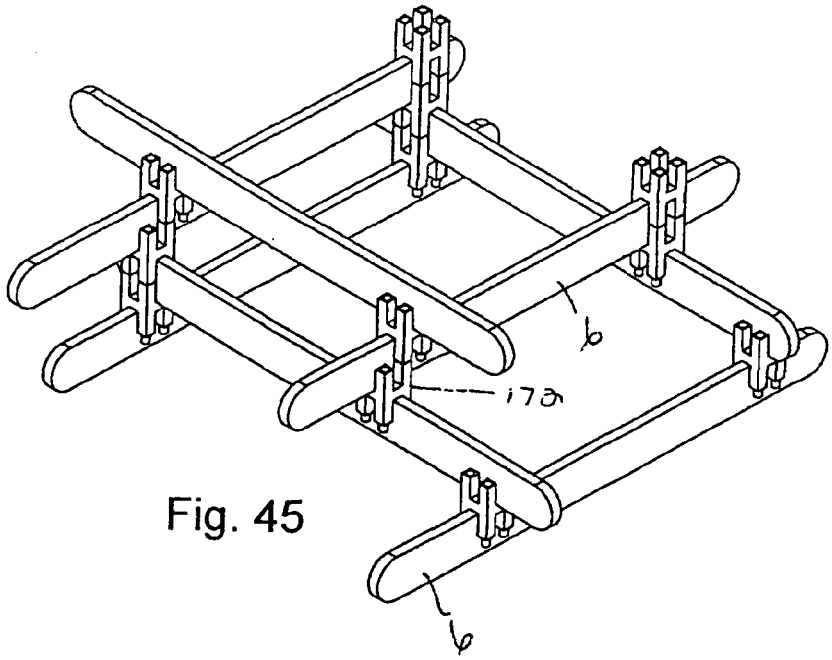
FIG. 45 shows a perspective view of a possible structural configuration built using the present invention.

Referring to FIG. 45, shown is an additional embodiment of the structural piece 172 of the present invention. The structural piece forms a generally three-dimensional H-shaped piece defining a plurality of channels 29. This H-shaped connector is preferably configured with male portions 177 opposed by female portions 175 on the other so that they can be stacked together with the male portions inserted into the female portions. The Figure further shows utilization of such structural pieces 172 to interconnect a number of popsicle sticks (or other structural pieces).

Figure 46:
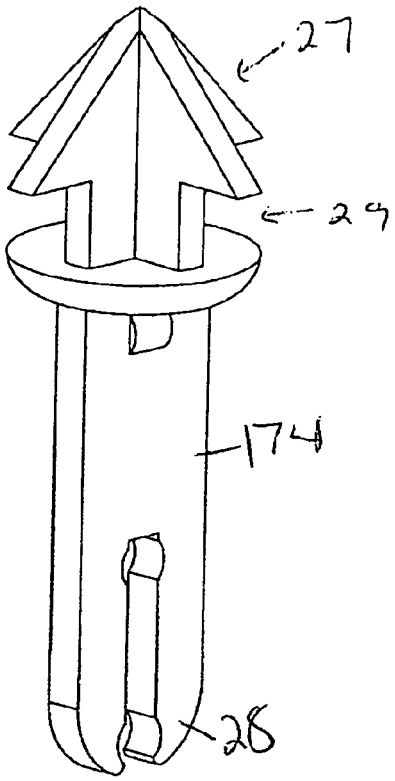
FIG. 46 shows a perspective view of a thirtieth embodiment of a structural element of the present invention.

Referring now to FIG. 46, shown is a structural piece 174 configured for pressing through a plane of surface (such as a sheet of cardboard so that the prong portion 27 presses through the cardboard (or a hole in said cardboard)) and the resulting hole is able to be received within the channel 29. As such this embodiment of the structural piece can be used to attach the present invention to a sheet of cardboard or other material.

Figure 47:
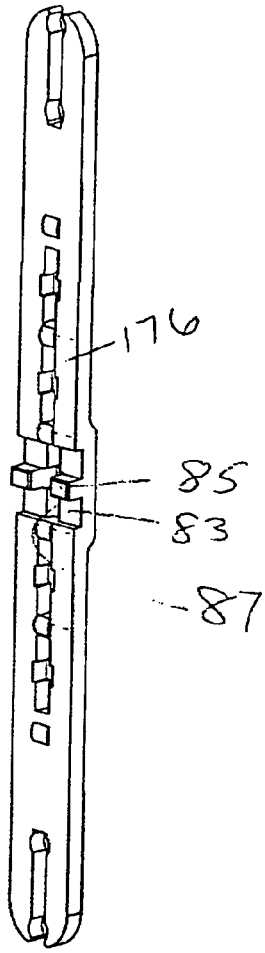
FIG. 47 shows a perspective view of a thirty-first embodiment of a structural element of the present invention.
Figure 48:
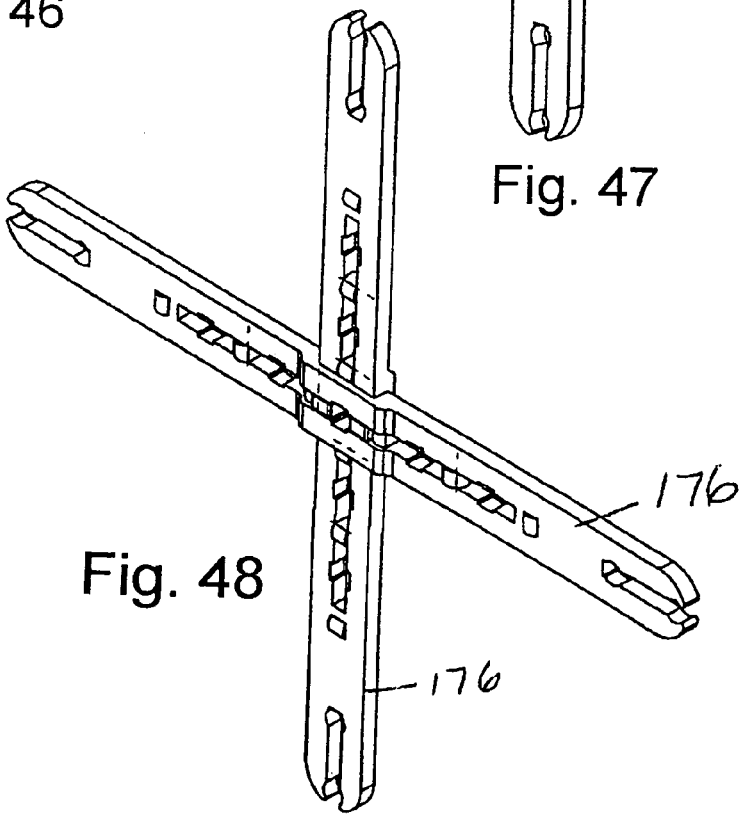
FIG. 48 shows a perspective view of a two of the embodiments of FIG. 47 shown snapped together.

FIGS. 47-48 shows an embodiment of a different type of structural piece 176 of the present invention. This structural piece 176 having defined there along at least one channel 83 and at least one mating lock 85. In the present invention, two of such structural pieces 176 can be effectively snapped together as shown in FIG. 48 with the adjacent channels aligning and the locks 85 snapping into the opposing holes 87. As such, a single structural piece can be combined together to make a X-shaped structural piece.

Figure 49:
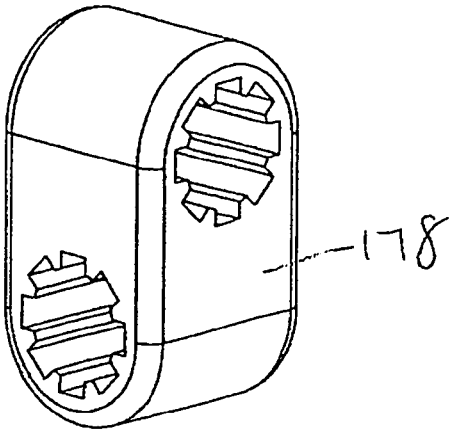
FIG. 49 shows a perspective view of a thirty-second embodiment of a structural element of the present invention.
Figure 50:
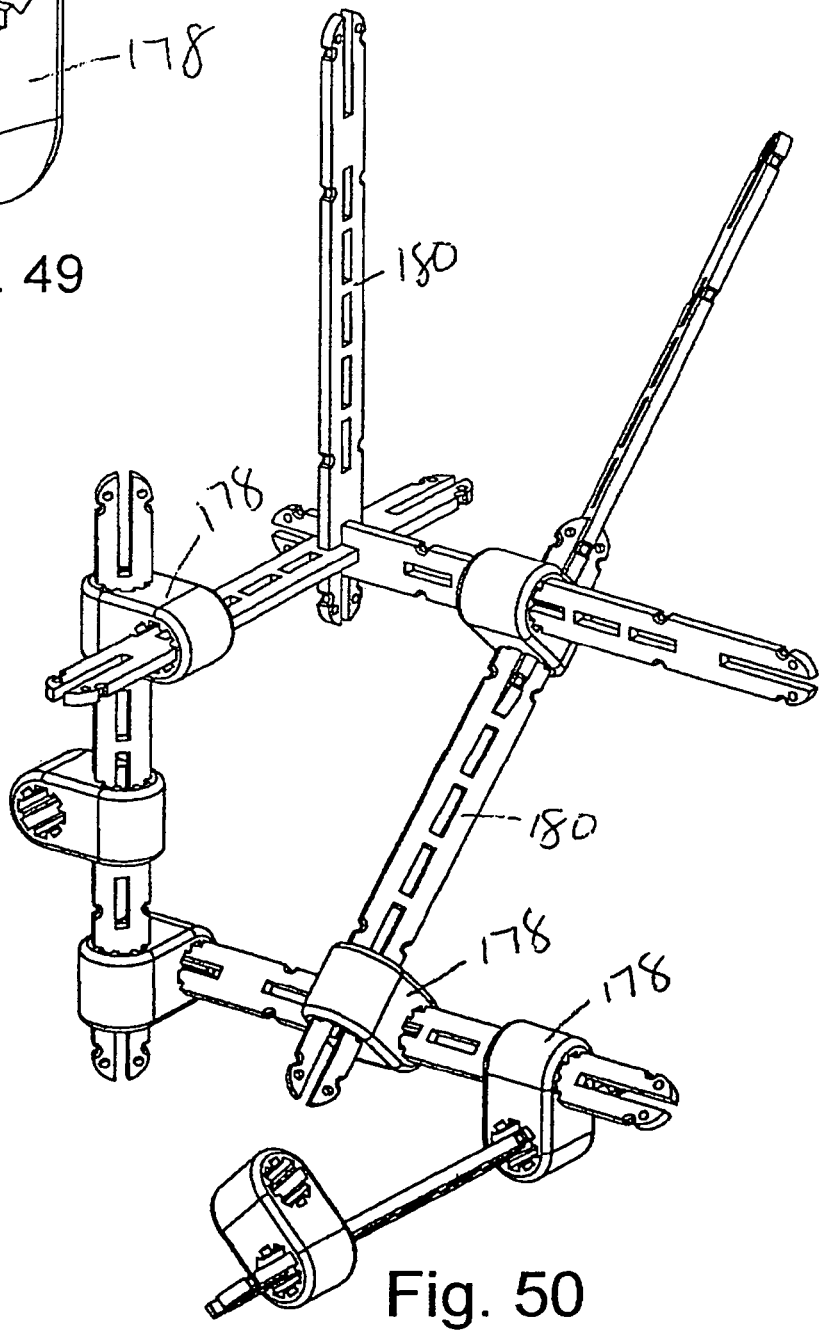
FIG. 50 shows a perspective view of a possible structural configuration built using the element of FIG. 49.

Referring now to FIGS. 49 and 50, shown is yet another embodiment of a structural piece 178 of the present invention. This structural piece 178 forms centrally a U-joint connector, having one or more angular orientation holes 26. It is preferred (but not shown) that a swivel or other pivot be configured with the present invention thereby allowing the invention to be rotated and/or rotated and locked in a particular orientation. FIG. 50 shows the utilization of such connectors with an additional structural pieces 180 to form structures at various angles and orientations.

Figure 53:
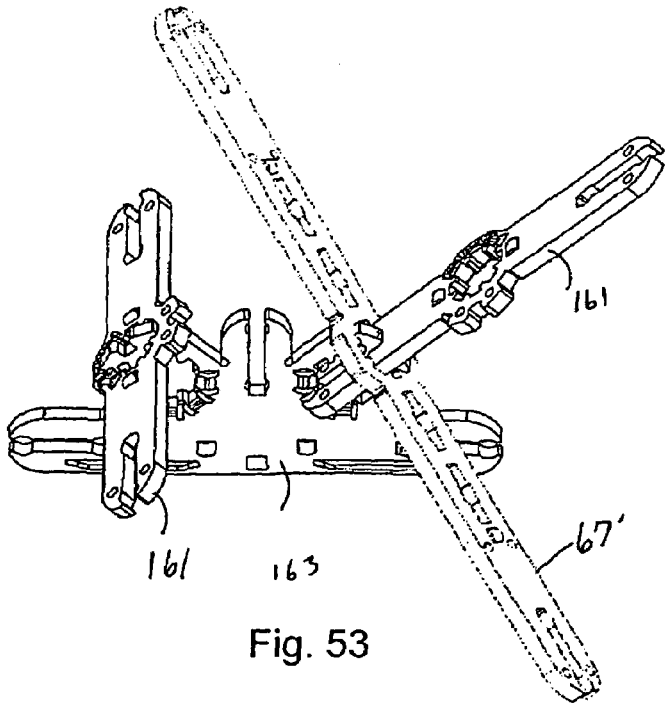
FIG. 53 is a perspective view of the thirty-third and thirty-fourth embodiments of structural elements of the present invention shown in a building structure.
Figure 54:
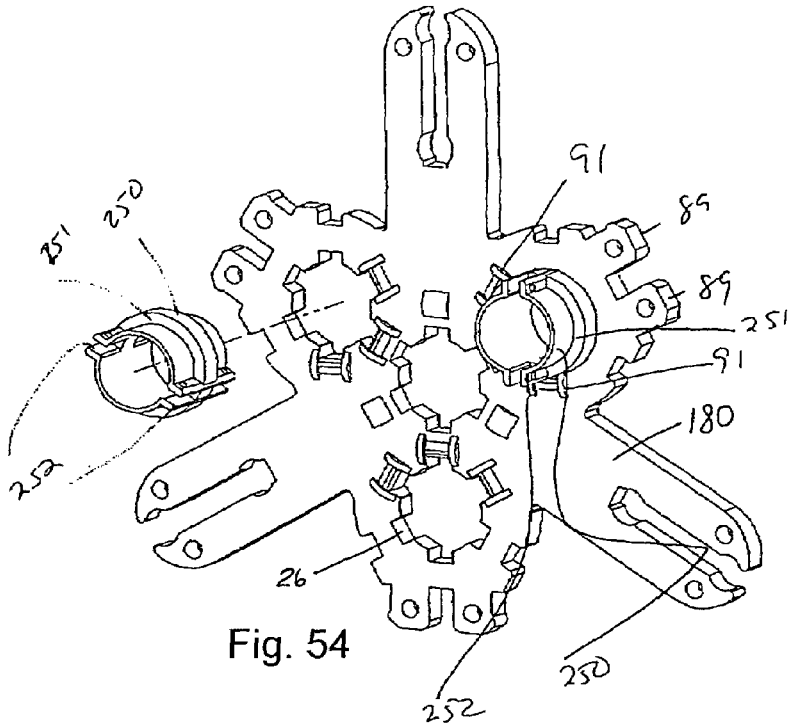
FIG. 54 is a perspective view of the thirty-fifth and thirty-sixth embodiments of structural elements of the present invention shown interconnected together.

Referring now to FIGS. 53 and 54, shown are structural pieces 161, 163, 180 including a couple of new (to this disclosure) connector types. These figures show the inclusion of external snap fit connectors 89 on the outer surface of the structural pieces, particularly adjacent an angular orientation hole 26. These external snap fit connectors 89 are configured for connecting with angular orientation holes, slot connectors, locking slot connectors, etc. of adjacent structural pieces. An example of one such connection can be seen in FIG. 53 where structural piece 161 connects with structural piece 163 via said external snap fit connectors 89.

Also shown in FIGS. 53 and 54 are locking ridge lateral blocks 91 which can be used to limit the rotation of key connectors attaching thereto. Preferably the lateral blocks have extending there-between a locking ridge thereby allowing the key connector locking portion of a second structural piece to connect thereto. Such a connection can be seen in FIG. 53.

Figure 72:
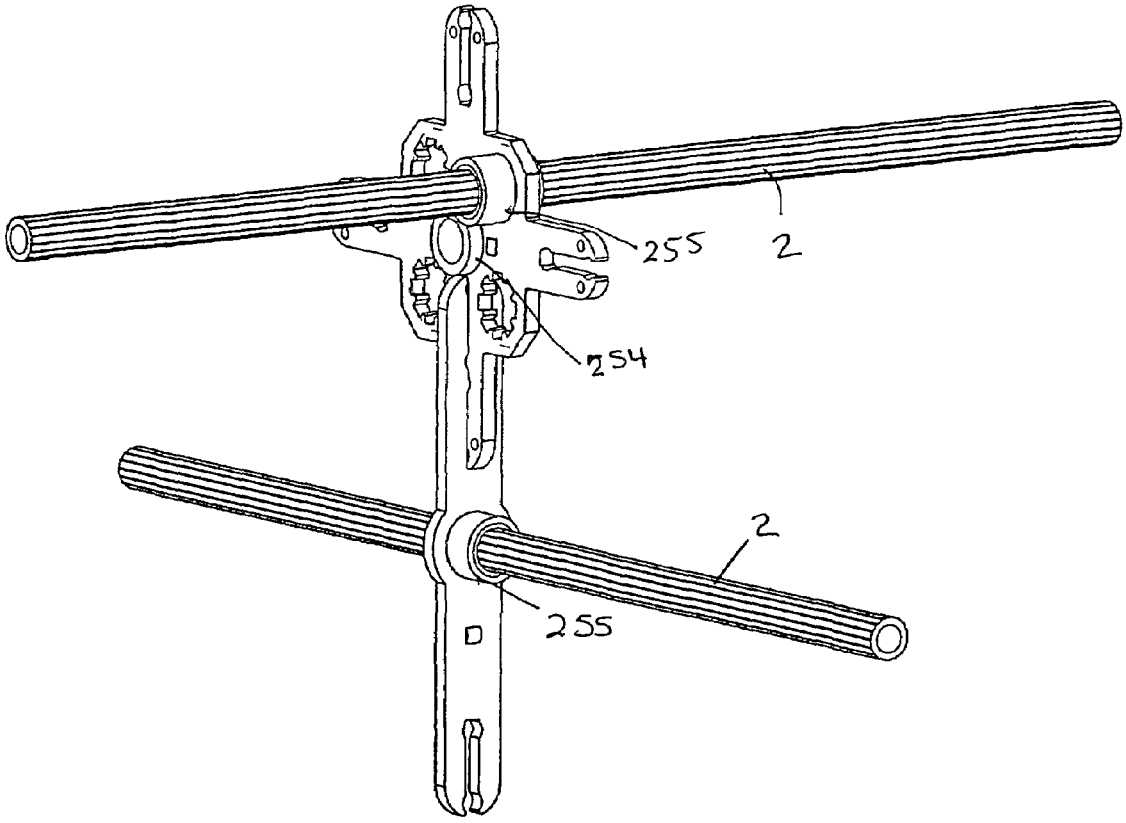
FIG. 72 is a perspective view of a structural piece constructed using the present invention.
Figure 73:
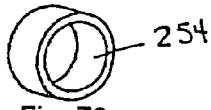
FIG. 73 is a perspective view of the forty-ninth embodiment of a structural element of the present invention.
Figure 74:
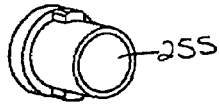
FIG. 74 is a perspective view of the fiftieth embodiment of a structural element of the present invention.
Figure 75:
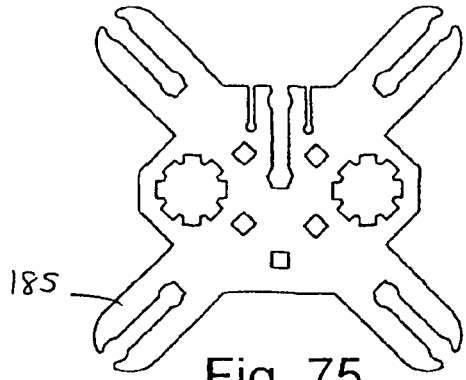
FIG. 75 is a plan view of the fifty-first embodiment of a structural element of the present invention.
Figure 76:
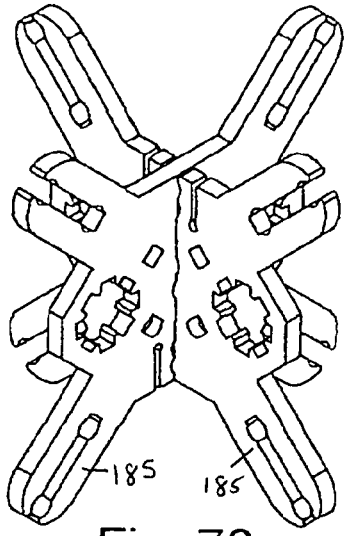
FIG. 76 is a perspective view of a structure created using the fifty-first embodiment of FIG. 75.
Figure 77:
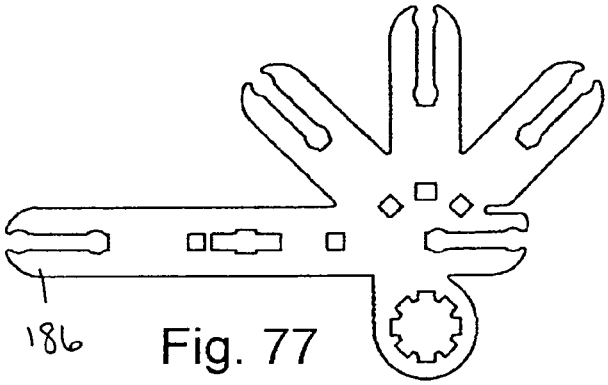
FIG. 77 is a plan view of the fifty-second embodiment of a structural element of the present invention.
Figure 79:
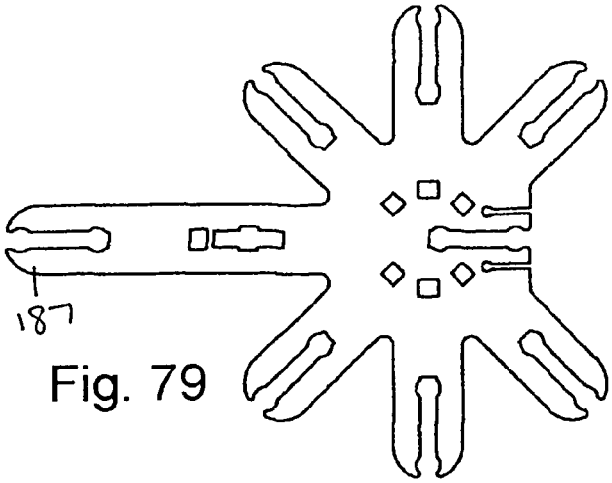
FIG. 79 is a plan view of the fifty-third embodiment of a structural element of the present invention.
Figure 78:
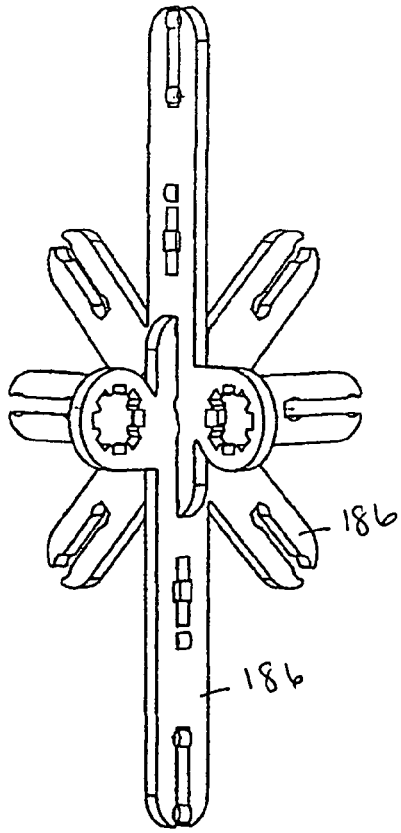
FIG. 78 is a perspective view of a structure created using the fifty-second embodiment of FIG. 77.
Figure 80:
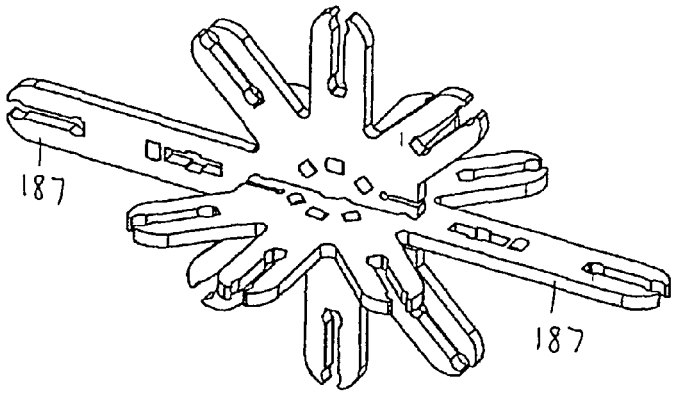
FIG. 80 is a perspective view of a structure created using the fifty-third embodiment of FIG. 79.

FIG. 54 further shows a connection hub 250. Such a connection hub serves a similar purpose as the cylinder connector 40 discussed previously. The connection hub 250 having a rim 251 for limiting movement of the hub within an annular orientation hole and preferably includes at least one locking flange 252 for preventing the rotation of the connection hub 250 within said annular orientation hole 26. Other styles of connection hubs (254, 255) are shown in FIGS. 72-74. FIG. 72 showing the hubs interconnected with axles/tubes/rods 2.

Figure 55:
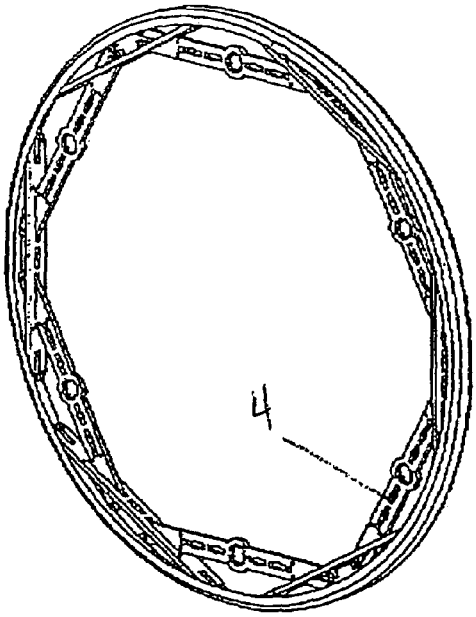
FIG. 55 is a perspective view of a flying disc created using the present invention.
Figure 56:
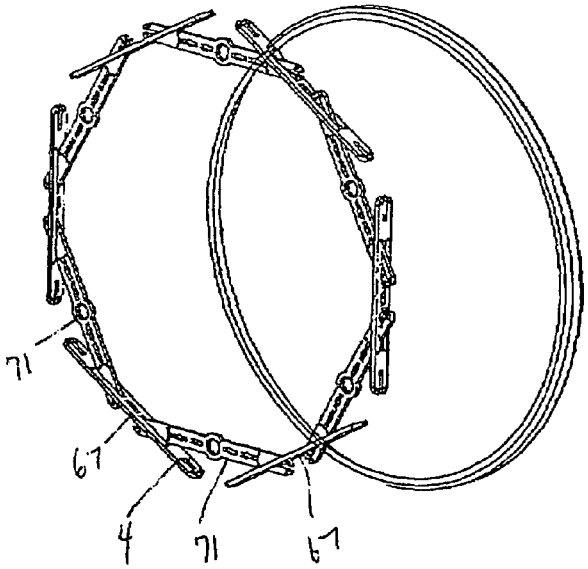
FIG. 56 is an exploded view of FIG. 55.

Referring now to FIGS. 55 and 56, shown is one embodiment of a flying disc created using the present invention. The flying disc comprising a hoop 4 created using a number of different structural pieces (71, 67) of the present invention covered with a cover 5. Preferably the cover 5 has a rim 7 which allows the cover 5 to snugly "cover" the hoop 4.

Figure 57:
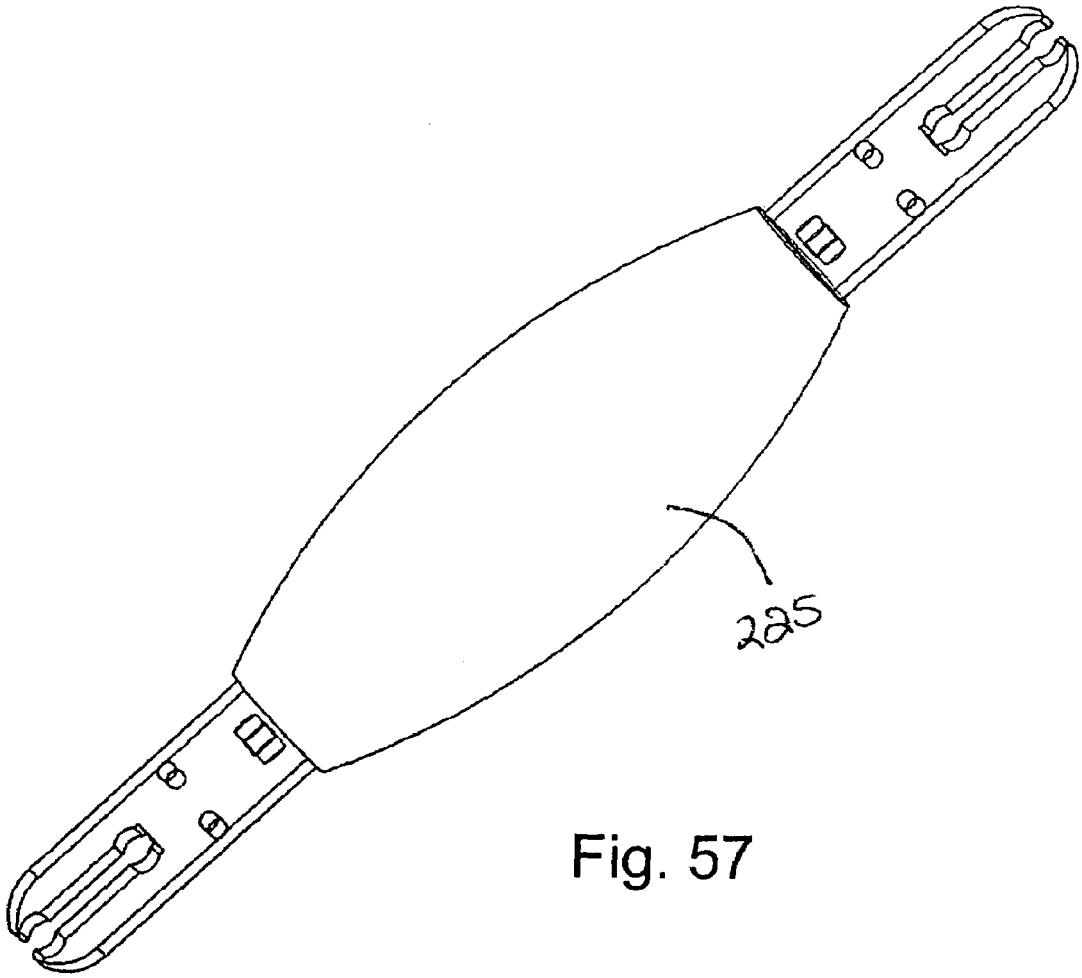
FIG. 57 is a perspective view of a thirty-seventh embodiment of a structural element of the present invention.

Referring now to FIG. 57, shown is a structural connector 225 including a light emitting source, such as a LED, halogen bulb, incandescent bulb, laser, etc. It is envisioned that the connector ends of this structural connector (as well as connectors attaching thereto) could be clear, so that light emanating from the light emitting source would travel through adjacent structural connectors much like light through fiber optics. It is preferred that one LED be located at each end of the structural connector 225, these LEDs having an on/off control switch, an internal battery or other low voltage power source (USB, solar, etc.), and a computer chip to control programmed light patterns.

Figure 60:
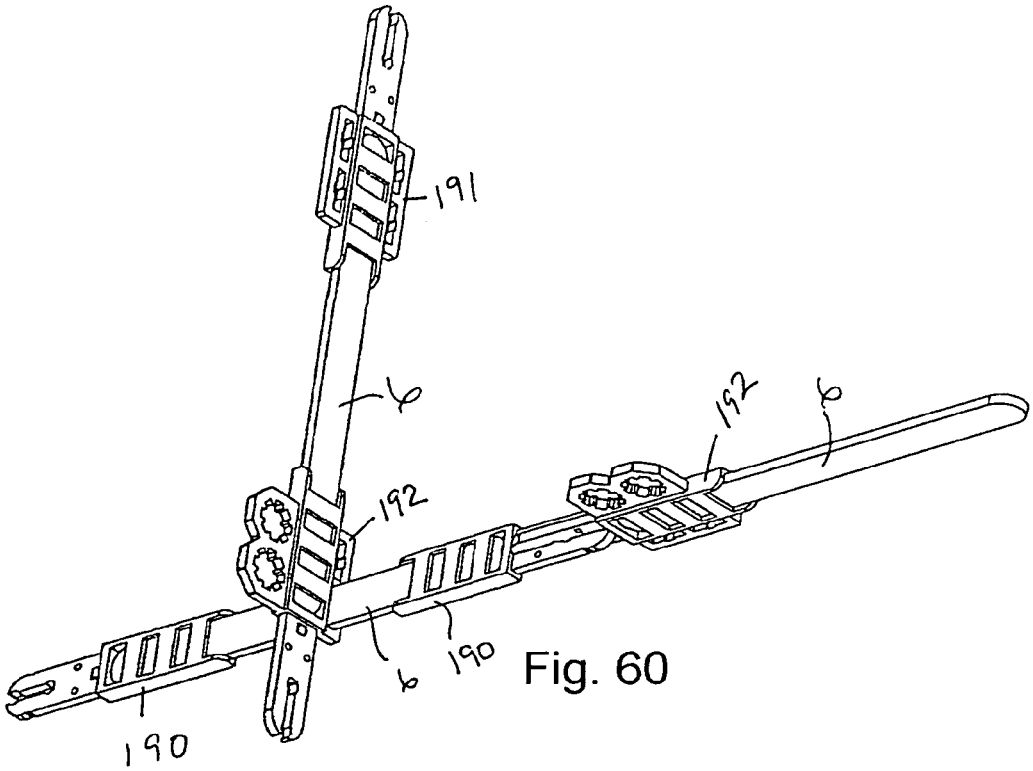
FIG. 60 is a perspective view showing the thirty-ninth, fortieth, and forty-first embodiments of structural elements of the present invention attached together using popsicle sticks.
Figure 61:
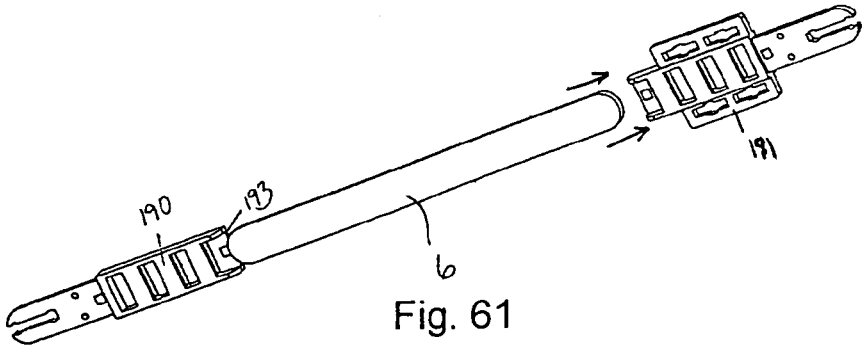
FIG. 61 is a partial, exploded, rotated, perspective view of the embodiment of FIG. 60.
Figure 62:
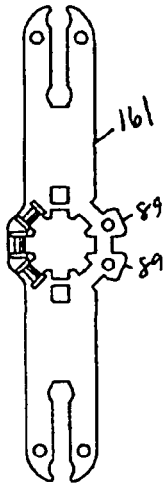
FIG. 62 is a plan view of the thirty-third embodiment shown in FIG. 53.
Figure 63:
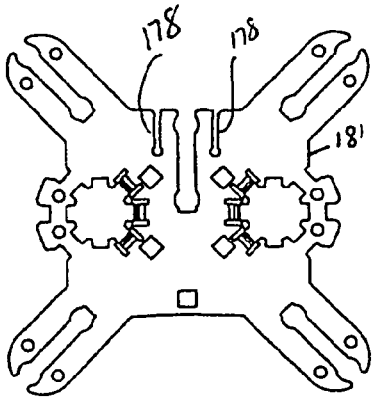
FIG. 63 is a plan view of a forty-second embodiment of a structural element of the present invention.

Referring to FIGS. 60 and 61, shown are various embodiments of structural pieces referred to as popsicle stick connectors. These connectors 190, 191, 192 configured for receiving a popsicle stick 6 (or similarly dimensioned item) within one end 193, thereby allowing a popsicle stick to interconnect with other structural pieces of the present invention.

Figure 58:
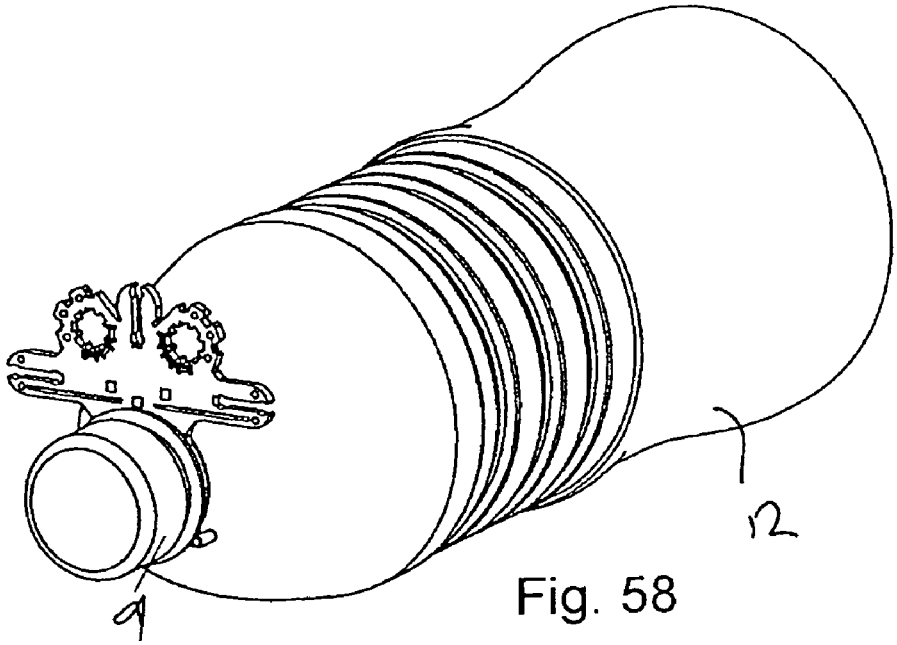
FIG. 58 shows an environmental, perspective view showing the thirty-eighth embodiment of a structural element of the present invention attached to a water bottle.
Figure 59:
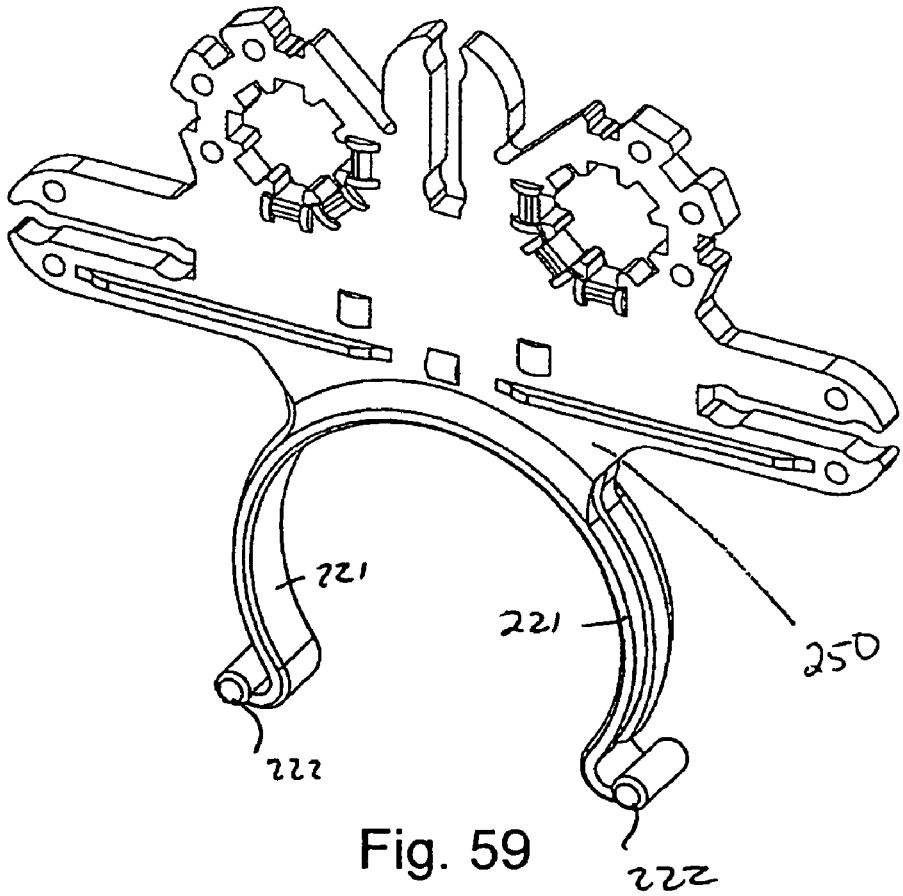
FIG. 59 is a perspective view of the embodiment of FIG. 58.
Figure 64:
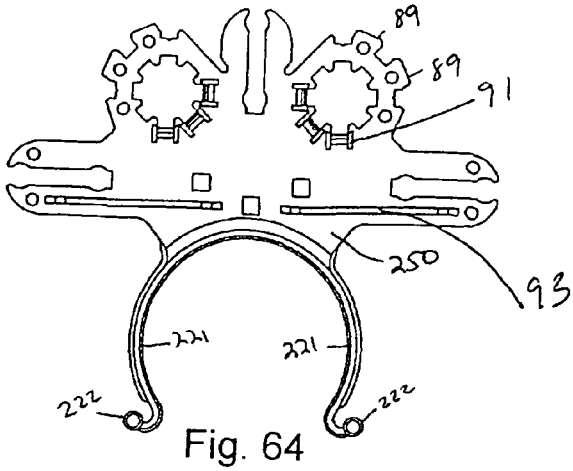
FIG. 64 shows a plan view of a forty-third embodiment of a structural element of the present invention.
Figure 65:
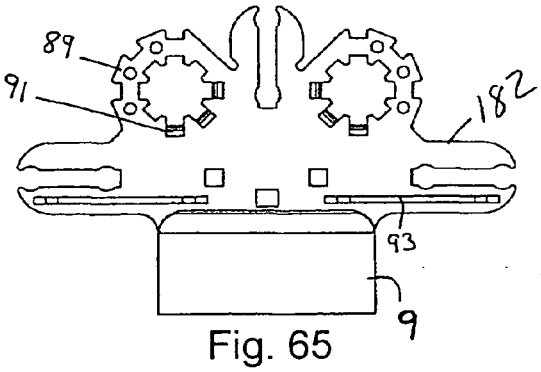
FIG. 65 shows a plan view of a forty-fourth embodiment of a structural element of the present invention.

Referring now to FIGS. 58, 59, 64 and 65, shown are various other always of attaching the construction elements of the present invention to a water bottle 12 (preferably capped with a cap 9). For instance, FIGS. 58, 59, and 64 show a snap fit structural piece 250 for connection to the neck of a water bottle 12. The snap fit structural piece 250 having a pair of curving flanges 221 terminating in a pair of locking connectors 222. It is preferred that a rubber band or other device be used to extend between the locking connectors after snapping onto said bottle neck. This embodiment further having the external snap fit connectors 89 and locking ridge lateral locks 91 discussed previously. This embodiment (and related embodiments) further has a structural stiffener or reinforcement 93, namely a ridge of plastic molded thereon for stiffening the piece. FIG. 65 showing the attachment of the structural piece directly to a bottle cap 9 (rather than using the snap fit structural piece previously discussed).

Figure 66:
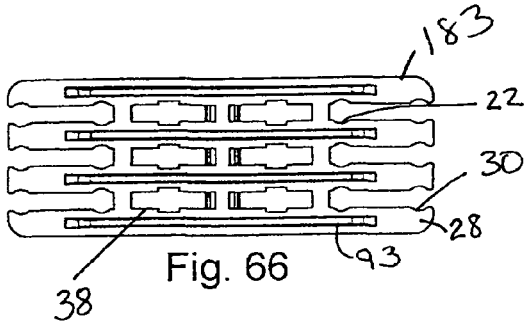
FIG. 66 shows a plan view of a forty-fifth embodiment of a structural element of the present invention.

Referring now to FIG. 66, shown is another example of a structural piece 183. This structural piece 183 configured for interconnecting a plurality of appendages of other structural pieces together in series.

Figure 29:
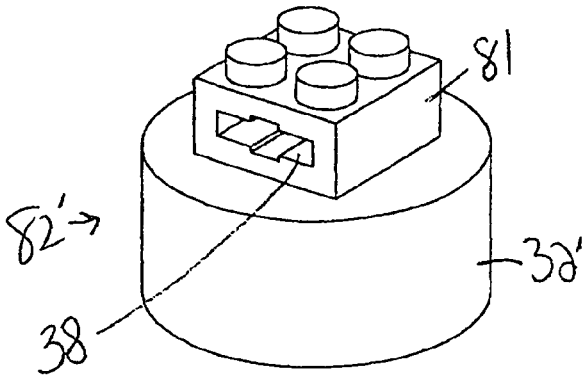
FIG. 29 shows a plan view of a twenty-first embodiment of a structural element of the present invention.
Figure 67:
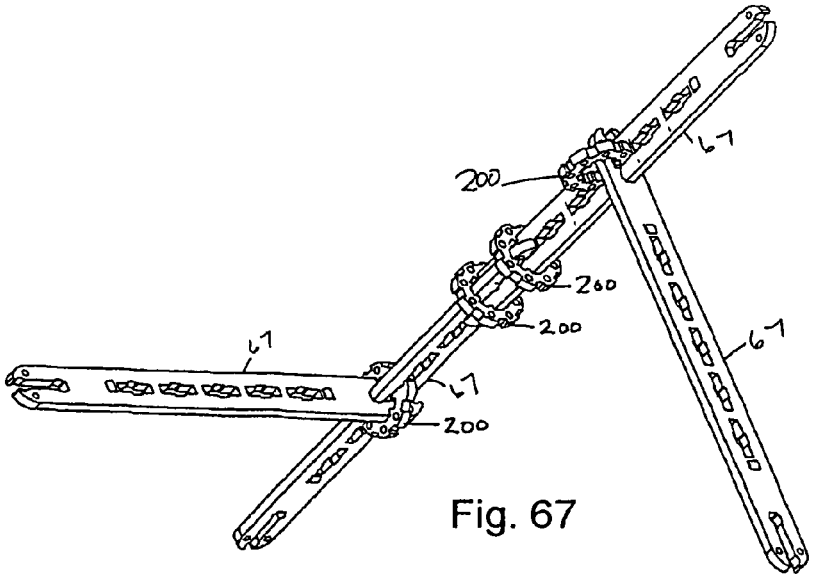
FIG. 67 shows a perspective view of one type of structure constructed using the forty-sixth embodiment (FIG. 69) and other structural pieces.
Figure 68:
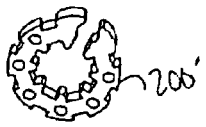
FIG. 68 is a perspective view of the forty-seventh embodiment of a structural element of the present invention.
Figure 69:
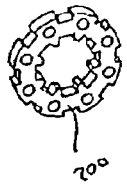
FIG. 69 is a perspective view of the forty-sixth embodiment of a structural element of the present invention.

Referring now to FIGS. 67-69, shown are structural pieces which are generally circular in shape. FIG. 68 shows a C-shaped structural piece 200' and FIG. 29 shows a circular structural piece 200. These structural pieces particularly configured for locking other structural pieces together and for providing additional attachment locations (see FIG. 67) where a number of structural pieces 67 are locked together using a number of circular structural pieces 200.

Figure 70:
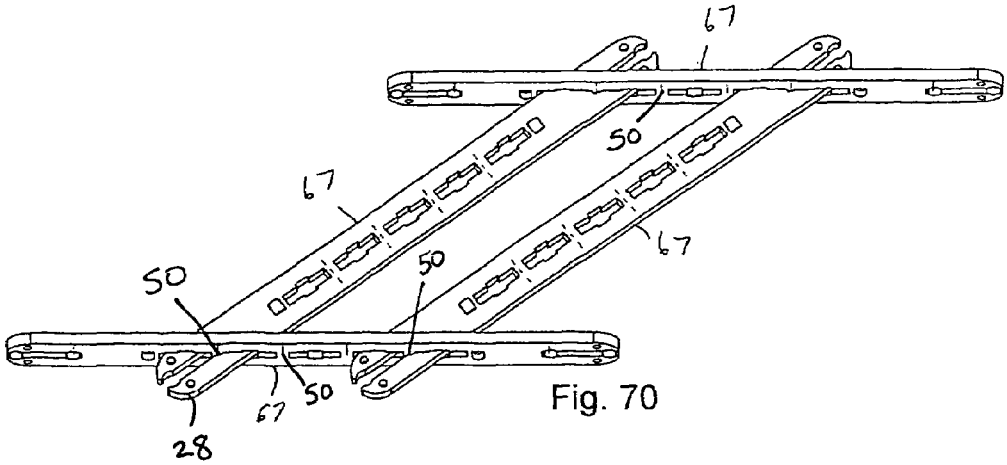
FIG. 70 is a perspective view of a structural piece constructed using the present invention.

FIG. 70 showing how key connectors connecting on the pivot hubs of adjacent locking slot connectors can form a building structure from structural pieces 67 which allows a parallelogram structure to pivot between a rhombic structure to a rectangular (generally) structure. In this figure it can be seen that the two prongs of the key connector 28 are positioned with the center post 50 there between. Such a connection allowing the structural piece 67 to rotate or pivot at the connection (where the center post 50 is snapped within the pivot portion 22) assuming that the distal end of the structural piece is free.

Figure 71:
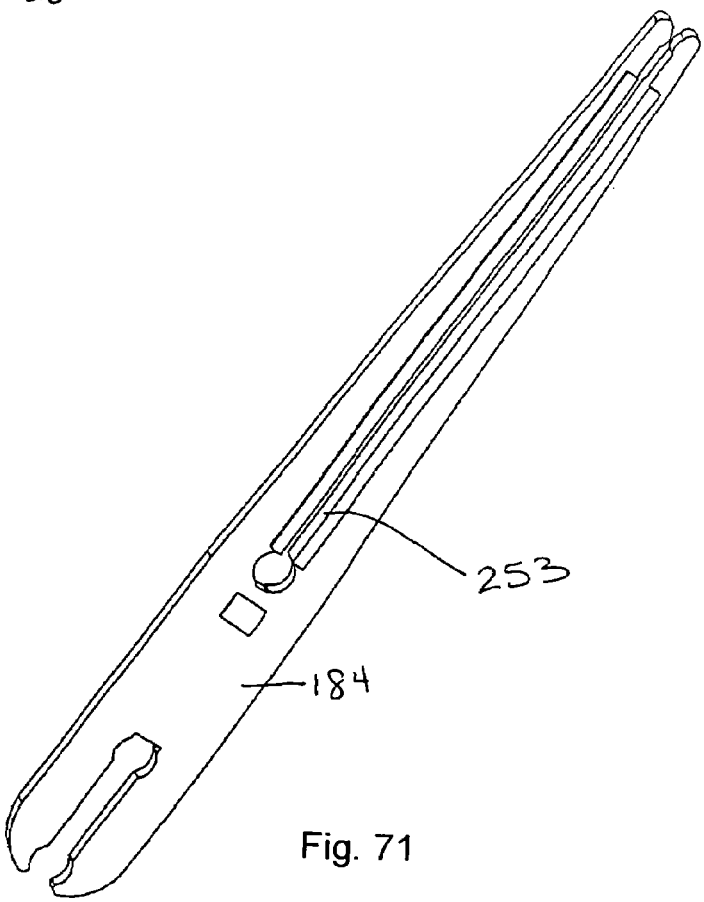
FIG. 71 is a perspective view of the forty-eighth embodiment of a structural element of the present invention.

FIG. 71 showing a planar connector structural piece 184 including a slot 253 for receiving a planar object (such as a piece of paper, cardboard, tin, wood, plastic, etc.) therein. An example of the use of such a piece 184 would be for attachment of an airplane wing to a body consisting of other structural pieces.

FIGS. 75, 76, 77, 78, 79 and 80 showing some additional embodiments of structural pieces 185, 186, 187 and the structures that can be created through joining a mating structural piece together.

Figure 82:
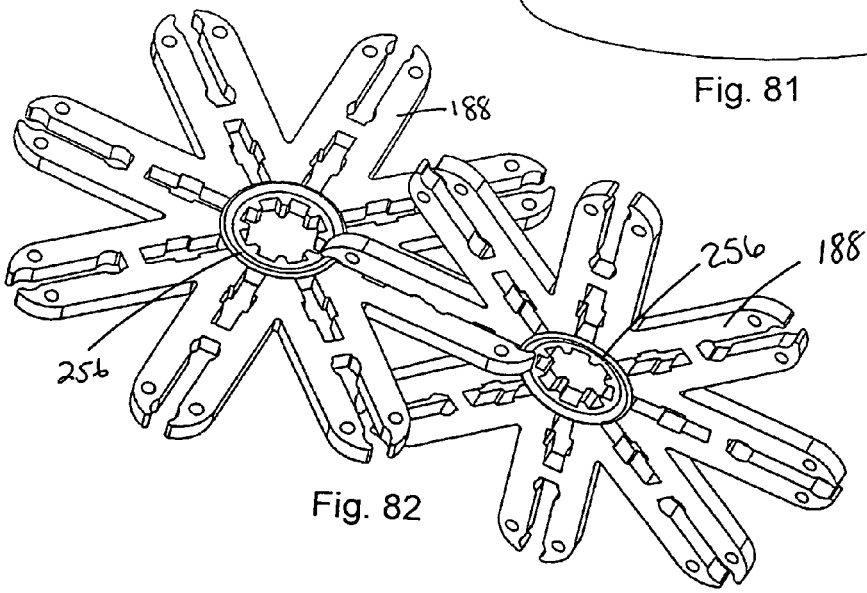
FIG. 82 shows a perspective view of a pair of the fifty-fifth embodiment of a structural element of the present invention used together in a structure.

FIG. 82 shows another type of structural piece, namely a central rim hub structural piece 188. This structural piece 188 having a ring 256 surrounding its central angular orientation hole configured for locking engagement with the key connector locking portion of a structural element attaching thereto. While using locking ridges is the preferred manner of locking two pieces together, it is (as can be seen here) possible to lock the pieces together in a number off different ways, all of which are equivalents.

Figure 83:
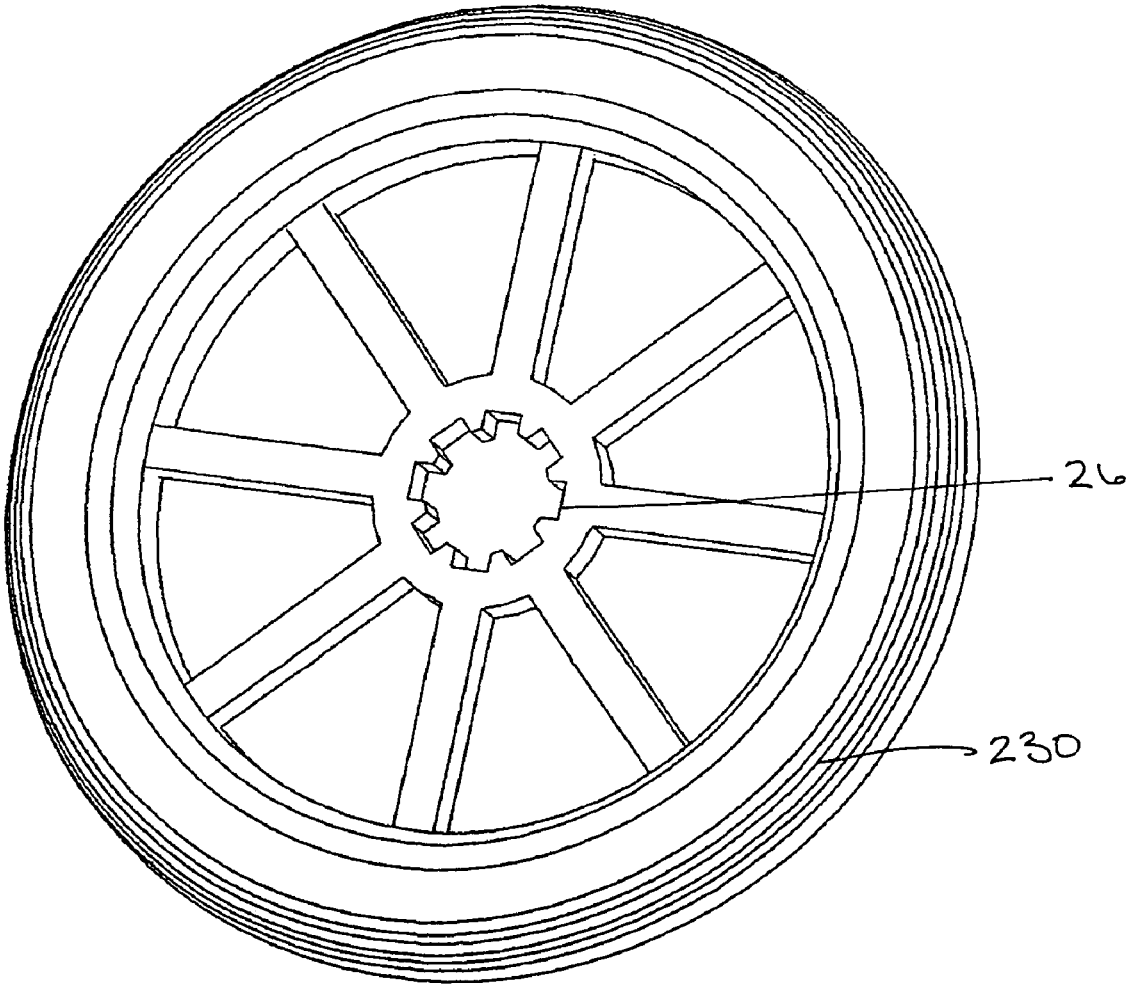
FIG. 83 shows a perspective view of a fifty-sixth embodiment of a structural element of the present invention.
Figure 84:
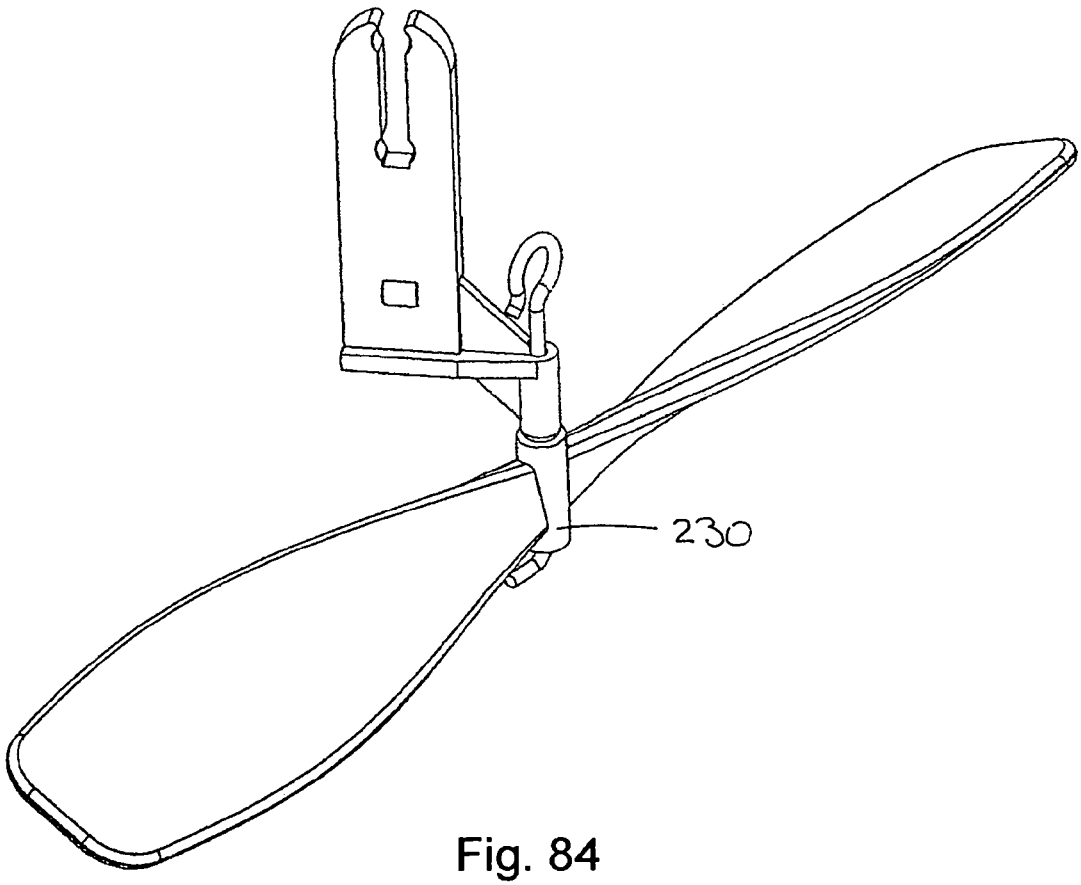
FIG. 84 shows a perspective view of a fifty-seventh embodiment of a structural element of the present invention.

FIG. 83 shows a wheel 230 configured for use with the structural pieces of the present invention. This wheel embodiment showing an integral angular orientation hole 26 connector which could be used with one of the hubs previously mentioned to form a wheel configured for rotation. FIG. 84 shows a propeller 230 configured for use with the present invention's structural pieces.

Figure 85:
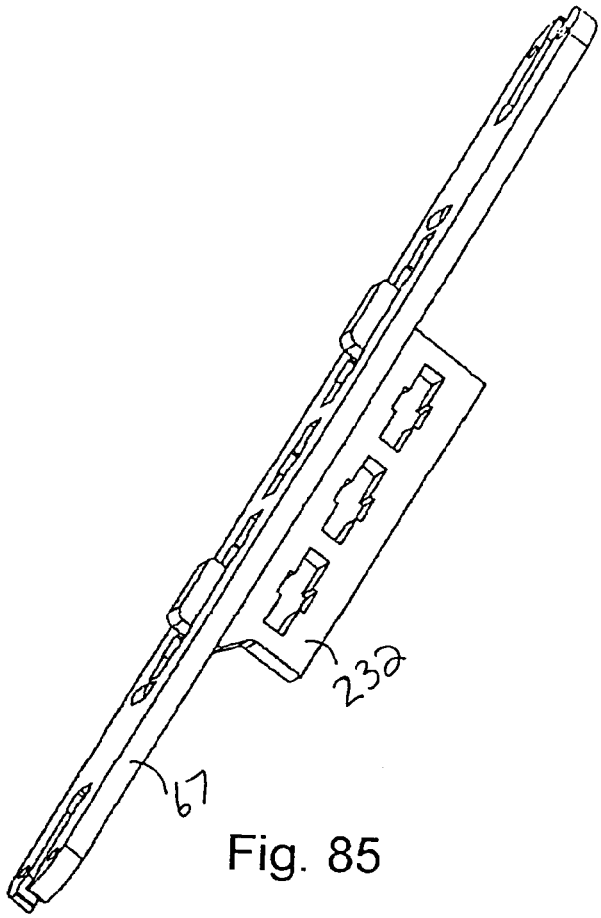
FIG. 85 is a perspective view showing a structure built using a structural element and the fifty-eighth embodiment of the present invention.
Figure 86:
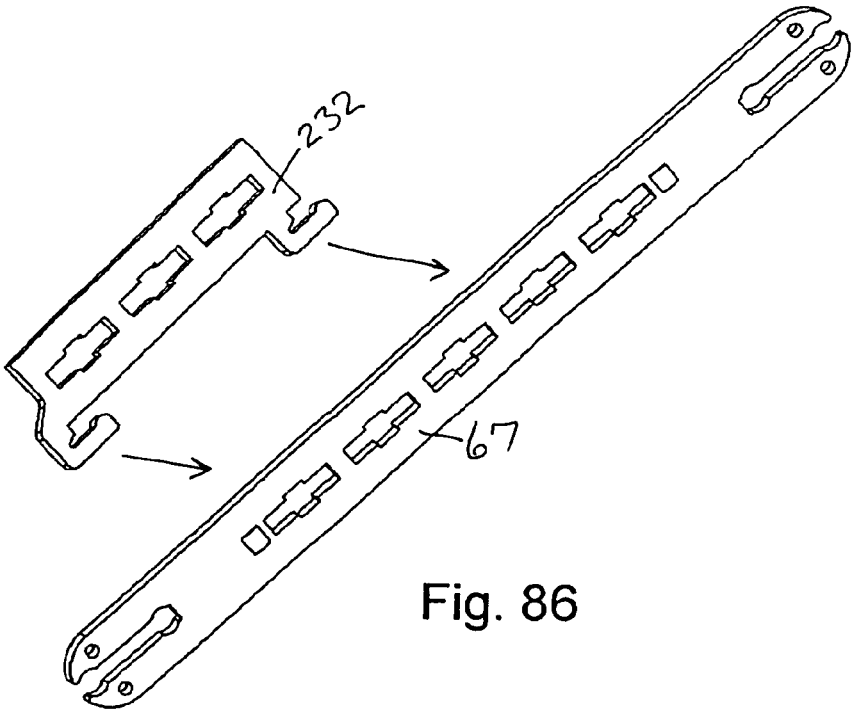
FIG. 86 is a rotated, exploded view of the embodiment of FIG. 85.
Figure 87:
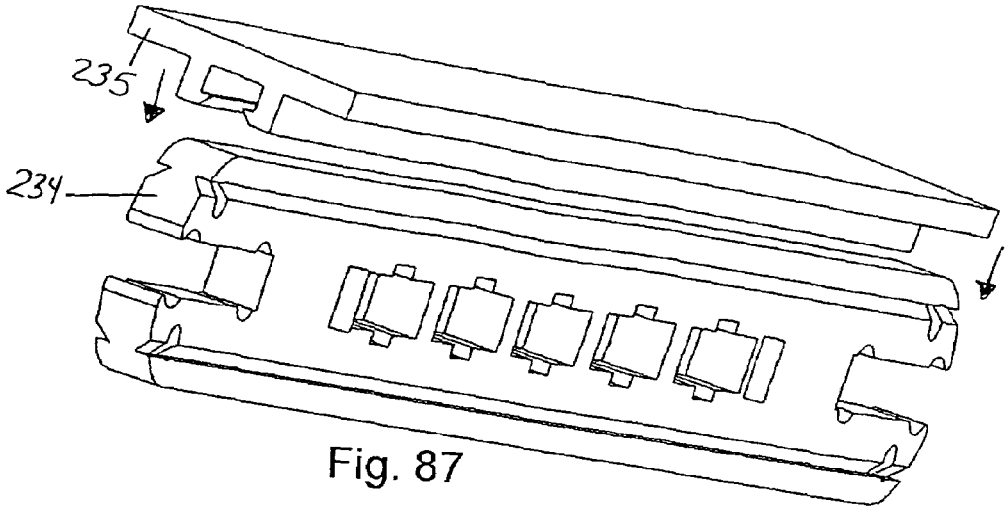
FIG. 87 shows a perspective view of a fifty-ninth and sixtieth embodiments of the present invention.
Figure 88:
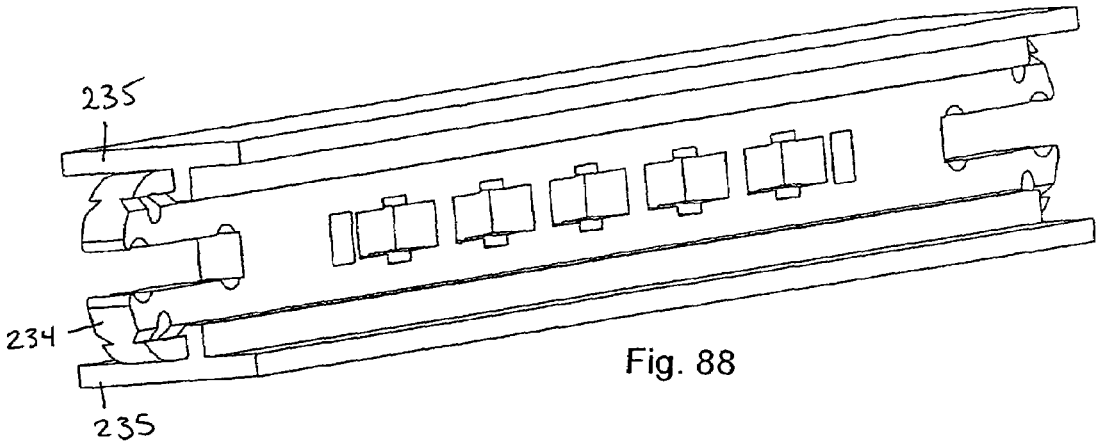
FIG. 88 shows the embodiments of FIG. 87 snapped together.
Figure 89:
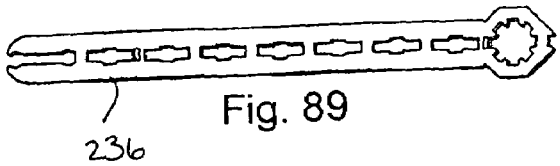
FIG. 89 shows a plan view of a sixty-first embodiment of a structural element of the present invention.

FIGS. 85 and 86 showing a perpendicular connector 232 structural piece for attachment with another structural piece 67 thereby allowing for perpendicular connection thereto. FIGS. 87 and 88 showing a snap fit cover system for a structural piece 234 where the structural piece 234 has a pair of channels defined therein which are configured for receiving therein a locking attachment of a covering piece 235 or other structure. FIG. 89 shows another structural piece 236.

Thus, in one embodiment of the present invention, the present invention comprises a planar construction toy formed of molded plastic. The planar construction toy comprising a first construction element piece and a second element piece, these pieces configured for attaching together. The first construction element piece defining a first plane. This first construction element piece having a first end extending to a second end thereby defining a first axis. The first end having a first slot defined therein, this first slot extending along a portion of the first axis from the first end a predetermined distance towards the second end. The first slot having a first outer end adjacent the first end opposite a first inner end. The first slot having defined therein a pair of opposing first outer indentions within the first slot adjacent the first outer end. The first slot further having a pair of opposing first inner indentations within the first slot adjacent the first inner end, the first inner and outer indentations configured for coupling with the second construction element piece. The first construction element piece further comprising at least one first locking ridge adjacent the first inner end.

The second construction element piece defining a second plane. The second construction element piece having a third end extending to a fourth end thereby defining a second axis. The third end having a second slot defined therein. The second slot extending along a portion of the second axis from the third end a predetermined distance towards the fourth end. The second slot having a second outer end adjacent the third end opposite a second inner end, wherein the second slot having defined therein a pair of opposing second outer indentions within the second slot adjacent the second outer end. The second slot further having a pair of opposing second inner indentations within the second slot adjacent the second inner end. The second inner and outer indentations configured for coupling with the first construction element piece. The second construction element piece further comprising at least one second locking ridge adjacent the second inner end.

In use, the first slot and the second slot are configured for interfitting engagement, the first locking ridge is received into at least one of the second outer indentions, and the second locking ridge is received into at least one of the first outer indentations, thereby locking the first construction element piece to the second construction element piece. This results, in this embodiment, in the first plane being generally perpendicular to the second plane.

Additionally, it is preferred that the first construction element piece have a top side opposite a bottom side, and said first slot being disposed in the piece from the top side to the bottom side. It is preferred that the first construction element piece further comprise a pair of apertures disposed in the piece from the top side to the bottom side along the first axis. It is further preferred that the apertures be spaced apart a predetermined distance by a center post, this center post configured and dimensioned to be received into the second slot and held within the second inner indentations. Furthermore, it is preferred that the apertures be configured so the second construction element piece can be slid through the apertures. Likewise, it is preferred that the first construction element piece further comprises at least one aperture disposed in the piece from said top side to said bottom side along said first axis, said aperture comprising a plurality of flanges defining a plurality of orifices disposed at regular angles intersecting said first axis. It is preferred that the orifices be configured so the second construction element piece can be slid through the orifices.

The applicant has found an ideal mathematical relationship between the pieces of the present invention. While using such dimensioned pieces is not necessary, it does provide pieces of ideal sizes. Logically, other sizes and orientations are likewise available. In the preferred configuration, the structural pieces generally have a thickness from the top side to the bottom side of approximately 0.090 inches, and the appendages of the structural pieces have a width of approximately 0.375 inches. It is further preferred that the slot defined at the key connector be approximately 0.555 inches long. Another way of looking at measurements is the observation that in the preferred embodiment the length of the slot is determined according to the formula: $L=W+(T*2)$, wherein L=length of the first construction element piece slot; W=width of first construction element piece; and T=thickness from said top side to said bottom side of said first construction element piece. Additionally, for structural pieces which are "stick like," the length of said structural/element piece is determined according to the formula: $L=(W*9)+(T*12)$, wherein L=length of the first construction element piece; W=width of first construction element piece; and T=thickness from said top side to aid bottom side of said first construction element piece.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims and their equivalents. Unless explicitly recited, other aspects of the present invention as described in this specification do not limit the scope of the claims.

None of the description in the present application should be read as implying that any particular element, step or function is an essential element which must be included in the claim scope. The scope of patented subject matter is defined only by the allowed claims. Moreover, none of these claims are intended to invoke paragraph six of 35 U.S.C. §112 unless the exact words "means for" are followed by a participle.

As used herein, the terms "comprises," "comprising," or any other variation thereof, are intended to over a non-exclusive inclusion, such that a process, method, article, or apparatus that comprises a list of elements does not include only those elements but may include other elements not expressly listed or inherent to such process, method, article or apparatus. Further, no element described herein is required for the practice of the invention unless expressly described as "essential" or "critical."

I claim:

1. A planar construction toy formed of molded plastic, wherein said planar construction toy comprises:

a first construction element piece, said first construction element piece defining a first plane, said first construction element piece having a first end extending to a second end thereby defining a first axis, said first end having a first slot defined therein, said first slot extending along a portion of said first axis from said first end a predetermined distance towards said second end, said first slot having a first outer end adjacent said first end opposite a first inner end, wherein said first slot having defined therein a pair of opposing first outer indentions within said first slot adjacent said first outer end, wherein said first slot further having a pair of opposing first inner indentations within said first slot adjacent said first inner end, said first inner and outer indentations configured for coupling with a second construction element piece, said first construction piece further comprising at least one third slot defined in said first end, said third slot extending generally parallel to said first slot from said first end a predetermined distance towards said second end, said third slot having a third outer end adjacent said first end opposite a third inner end, wherein said third slot having defined therein a pair of opposing third outer indentions within said third slot adjacent said third outer end, wherein said third slot further having a pair of opposing third inner indentations within said third slot adjacent said third inner end, said third inner and outer indentations configured for coupling with a second construction element piece, said first construction element piece further comprising at least one first locking ridge adjacent said first inner end; and a second construction element piece, said second construction element piece defining a second plane, said second construction element piece having a third end extending to a fourth end thereby defining a second axis, said third end having a second slot defined therein, said second slot extending along a portion of said second axis from said third end a predetermined distance towards said fourth end, said second slot having a second outer end adjacent said third end opposite a second inner end, wherein said second slot having defined therein a pair of opposing second outer indentions within said second slot adjacent said second outer end, wherein said second slot further having a pair of opposing second inner indentations within said second slot adjacent said second inner end, said second inner and outer indentations configured for coupling with said first construction element piece, said second construction element piece further comprising at least one second locking ridge adjacent said second inner end;

wherein said first slot and said second slot are configured for interfitting engagement wherein said first locking ridge is received into at least one of said second outer indentions, and wherein said second locking ridge is received into at least one of said first outer indentations, thereby locking said first construction element piece to said second construction element piece, said first plane thus generally perpendicular to said second plane wherein said first construction element piece has a top side opposite a bottom side, wherein said first, second and third slots are disposed in said piece from said top side to said bottom side.

2. The planar construction toy of claim 1, wherein said first construction element piece further comprises a pair of apertures disposed in said piece from said top side to said bottom side along said first axis.

3. The planar construction toy of claim 2, wherein said apertures are spaced apart a predetermined distance by a center post, said center post configured and dimensioned to be received into said second slot and held within said second inner indentations.

4. The planar construction toy of claim 2, wherein said apertures are configured so said second construction element piece can be slid through said apertures.

5. The planar construction toy of claim 1, wherein said first construction element piece further comprises at least one aperture disposed in said piece from said top side to said bottom side along said first axis, said aperture comprising a plurality of flanges defining a plurality of orifices disposed at regular angles intersecting said first axis.

6. The planar construction toy of claim 5, wherein said orifices are configured so said second construction element piece can be slid through said orifices.

7. The planar construction toy of claim 1, wherein said first construction element piece has a thickness from said top side to said bottom side of approximately 0.090 inches.

8. The planar construction toy of claim 1, wherein said first construction element piece has a width of approximately 0.375 inches.

9. The planar construction toy of claim 1, wherein said first construction element piece slot is approximately 0.555 inches long.

10. The planar construction toy of claim 1, wherein the length of said slot is determined according to the formula: L=W+(T*2), wherein L=length of the first construction element piece slot; W=width of first construction element piece; and T=thickness from said top side to aid bottom side of said first construction element piece.

11. The planar construction toy of claim 1, wherein the length of said element piece is determined according to the formula: L=(W*9)+(T*12), wherein L=length of the first construction element piece; W=width of first construction element piece; and T=thickness from said top side to aid bottom side of said first construction element piece.

12. A planar construction toy formed of molded plastic, wherein said planar construction toy comprises a plurality of construction element pieces, said pieces each defining a first plane, each piece having a first end extending to a second end thereby defining an axis, said first end having a slot defined therein, said slot extending from said first end a predetermined distance towards said second end, said slot having an outer end adjacent said first end and an inner end, wherein said slot having defined therein a pair of opposing outer indentions within said slot adjacent said outer end, wherein said slot further having a pair of opposing inner indentations within said slot adjacent said inner end, said indentations configured for coupling with other construction element pieces, said piece further comprising at least one locking ridge adjacent said inner end for cooperating with the indentations on a second construction element piece to lock said pieces together, said first end further having at least one second slot defined therein, said second slot extending generally parallel to said slot from said first end a predetermined distance towards said second end, said second slot having a second outer end adjacent said first end and a second inner end, wherein said second slot having defined therein a pair of opposing second outer indentions within said second slot adjacent said second outer end, wherein said second slot further having a pair of opposing second inner indentations within said second slot adjacent said second inner end, said second inner and outer indentations configured for coupling with other construction element pieces.

13. The planar construction toy of claim 12, wherein said construction element pieces each have a top side opposite a bottom side, wherein said first slot is disposed from said top side to said bottom side.

14. The planar construction toy of claim 13, wherein said construction element pieces each further comprise a pair of apertures disposed in said piece from said top side to said bottom side along said first axis.

15. The planar construction toy of claim 14, wherein said apertures are spaced apart a predetermined distance by a center post, said center post configured and dimensioned to be received into said second slot and held within said second inner indentations.

16. The planar construction toy of claim 14, wherein said apertures are configured so said second construction element piece can be slid through said apertures.

17. The planar construction toy of claim 13, wherein said construction element pieces further each comprise at least one aperture disposed in said piece from said top side to said bottom side along said first axis, said aperture comprising a plurality of flanges defining a plurality of orifices disposed at regular angles intersecting said first axis.

18. A planar construction toy formed of molded plastic, wherein said planar construction toy comprises:

a first construction element piece, said first construction element piece defining a first plane, said first construction element piece having a first end extending to a second end thereby defining a first axis, said first end having a first slot defined therein, said first slot extending along a portion of said first axis from said first end a predetermined distance towards said second end, said first slot having a first outer end adjacent said first end opposite a first inner end, wherein said first slot having defined therein a pair of opposing first outer indentions within said first slot adjacent said first outer end, wherein said first slot further having a pair of opposing first inner indentations within said first slot adjacent said first inner end, said first inner and outer indentations configured for coupling with a second construction element piece, said first construction element piece further comprising at least one first locking ridge adjacent said first inner end, wherein said first construction element piece has a top side opposite a bottom side, wherein said first slot is disposed in said piece from said top side to said bottom side, wherein said first construction element piece further comprises a pair of apertures disposed in said piece from said top side to said bottom side along said first axis, wherein said apertures are spaced apart a predetermined distance by a center post, said center post configured and dimensioned to be received into said second slot and held within said second inner indentations, wherein said apertures are configured so said second construction element piece can be slid through said apertures, wherein said first construction element piece further comprises at least one aperture disposed in said piece from said top side to said bottom side along said first axis, said aperture comprising a plurality of flanges defining a plurality of orifices disposed at regular angles intersecting said first axis, wherein said orifices are configured so said second construction element piece can be slid through said orifices;

a second construction element piece, said second construction element piece defining a second plane, said second construction element piece having a third end extending to a fourth end thereby defining a second axis, said third end having a second slot defined therein, said second slot extending along a portion of said second axis from said third end a predetermined distance towards said fourth end, said second slot having a second outer end adjacent said third end opposite a second inner end, wherein said second slot having defined therein a pair of opposing second outer indentions within said second slot adjacent said second outer end, wherein said second slot further having a pair of opposing second inner indentations within said second slot adjacent said second inner end, said second inner and outer indentations configured for coupling with said first construction element piece, said second construction element piece further comprising at least one second locking ridge adjacent said second inner end;

wherein said first slot and said second slot are configured for interfitting engagement wherein said first locking ridge is received into at least one of said second outer indentions, and wherein said second locking ridge is received into at least one of said first outer indentations thereby locking said first construction element piece to said second construction element piece, said first plane thus generally perpendicular to said second plane.

19. The planar construction toy of claim 18, wherein the length of said element pieces are determined according to the formula: L=(W*9)+(T*12), wherein L=length of the first construction element piece; W=width of first construction element piece; and T=thickness from said top side to aid bottom side of said first construction element piece.

20. A planar construction toy formed of molded plastic, wherein said planar construction toy comprises:

a first construction element piece, said first construction element piece defining a first plane, said first construction element piece having a first end extending to a second end thereby defining a first axis, said first end having a first slot defined therein, said first slot extending along a portion of said first axis from said first end a predetermined distance towards said second end, said first slot having a first outer end adjacent said first end opposite a first inner end, wherein said first slot having defined therein a pair of opposing first outer indentions within said first slot adjacent said first outer end, wherein said first slot further having a pair of opposing first inner indentations within said first slot adjacent said first inner end, said first inner and outer indentations configured for coupling with a second construction element piece, said first construction element piece further comprising at least one first locking ridge adjacent said first inner end, wherein said first construction element piece has a top side opposite a bottom side, wherein said first slot is disposed in said piece from said top side to said bottom side, wherein said first construction element piece further comprises a pair of apertures disposed in said piece from said top side to said bottom side along said first axis, wherein said apertures are spaced apart a predetermined distance by a center post, said center post configured and dimensioned to be received into said second slot and held within said second inner indentations; and a second construction element piece, said second construction element piece defining a second plane, said second construction element piece having a third end extending to a fourth end thereby defining a second axis, said third end having a second slot defined therein, said second slot extending along a portion of said second axis from said third end a predetermined distance towards said fourth end, said second slot having a second outer end adjacent said third end opposite a second inner end, wherein said second slot having defined therein a pair of opposing second outer indentions within said second slot adjacent said second outer end, wherein said second slot further having a pair of opposing second inner indentations within said second slot adjacent said second inner end, said second inner and outer indentations configured for coupling with said first construction element piece, said second construction element piece further comprising at least one second locking ridge adjacent said second inner end;

wherein said first slot and said second slot are configured for interfitting engagement wherein said first locking ridge is received into at least one of said second outer indentions, and wherein said second locking ridge is received into at least one of said first outer indentations, thereby locking said first construction element piece to said second construction element piece, said first plane thus generally perpendicular to said second plane.

21. A planar construction toy formed of molded plastic, wherein said planar construction toy comprises:

a first construction element piece, said first construction element piece defining a first plane, said first construction element piece having a first end extending to a second end thereby defining a first axis, said first end having a first slot defined therein, said first slot extending along a portion of said first axis from said first end a predetermined distance towards said second end, said first slot having a first outer end adjacent said first end opposite a first inner end, wherein said first slot having defined therein a pair of opposing first outer indentions within said first slot adjacent said first outer end, wherein said first slot further having a pair of opposing first inner indentations within said first slot adjacent said first inner end, said first inner and outer indentations configured for coupling with a second construction element piece, said first construction element piece further comprising at least one first locking ridge adjacent said first inner end, wherein said first construction element piece has a top side opposite a bottom side, wherein said first slot is disposed in said piece from said top side to said bottom side, wherein the length of said slot is determined according to the formula: L=W+(T*2), wherein L=length of the first construction element piece slot; W=width of first construction element piece; and T=thickness from said top side to aid bottom side of said first construction element piece; and a second construction element piece, said second construction element piece defining a second plane, said second construction element piece having a third end extending to a fourth end thereby defining a second axis, said third end having a second slot defined therein, said second slot extending along a portion of said second axis from said third end a predetermined distance towards said fourth end, said second slot having a second outer end adjacent said third end opposite a second inner end, wherein said second slot having defined therein a pair of opposing second outer indentions within said second slot adjacent said second outer end, wherein said second slot further having a pair of opposing second inner indentations within said second slot adjacent said second inner end, said second inner and outer indentations configured for coupling with said first construction element piece, said second construction element piece further comprising at least one second locking ridge adjacent said second inner end;

wherein said first slot and said second slot are configured for interfitting engagement wherein said first locking ridge is received into at least one of said second outer indentions, and wherein said second locking ridge is received into at least one of said first outer indentations, thereby locking said first construction element piece to said second construction element piece, said first plane thus generally perpendicular to said second plane.

22. A planar construction toy formed of molded plastic, wherein said planar construction toy comprises:

a first construction element piece, said first construction element piece defining a first plane, said first construction element piece having a first end extending to a second end thereby defining a first axis, said first end having a first slot defined therein, said first slot extending along a portion of said first axis from said first end a predetermined distance towards said second end, said first slot having a first outer end adjacent said first end opposite a first inner end, wherein said first slot having defined therein a pair of opposing first outer indentions within said first slot adjacent said first outer end, wherein said first slot further having a pair of opposing first inner indentations within said first slot adjacent said first inner end, said first inner and outer indentations configured for coupling with a second construction element piece, said first construction element piece further comprising at least one first locking ridge adjacent said first inner end, wherein said first construction element piece has a top side opposite a bottom side, wherein said first slot is disposed in said piece from said top side to said bottom side, wherein the length of said element piece is determined according to the formula: L=(W*9)+(T*12), wherein L=length of the first construction element piece; W=width of first construction element piece; and T=thickness from said top side to aid bottom side of said first construction element piece; and a second construction element piece, said second construction element piece defining a second plane, said second construction element piece having a third end extending to a fourth end thereby defining a second axis, said third end having a second slot defined therein, said second slot extending along a portion of said second axis from said third end a predetermined distance towards said fourth end, said second slot having a second outer end adjacent said third end opposite a second inner end, wherein said second slot having defined therein a pair of opposing second outer indentions within said second slot adjacent said second outer end, wherein said second slot further having a pair of opposing second inner indentations within said second slot adjacent said second inner end, said second inner and outer indentations configured for coupling with said first construction element piece, said second construction element piece further comprising at least one second locking ridge adjacent said second inner end;

wherein said first slot and said second slot are configured for interfitting engagement wherein said first locking ridge is received into at least one of said second outer indentions, and wherein said second locking ridge is received into at least one of said first outer indentations, thereby locking said first construction element piece to said second construction element piece, said first plane thus generally perpendicular to said second plane.

23. A planar construction toy formed of molded plastic, wherein said planar construction toy comprises a plurality of construction element pieces, said pieces each defining a first plane, each piece having a first end extending to a second end thereby defining an axis, said first end having a slot defined therein, said slot extending along a portion of said axis from said first end a predetermined distance towards said second end, said slot having an outer end adjacent said first end and an inner end, wherein said slot having defined therein a pair of opposing outer indentions within said slot adjacent said outer end, wherein said slot further having a pair of opposing inner indentations within said slot adjacent said inner end, said indentations configured for coupling with other construction element pieces, said piece further comprising at least one locking ridge adjacent said inner end for cooperating with the indentations on a second construction element piece to lock said pieces together; wherein said construction element pieces each have a top side opposite a bottom side, wherein said first slot is disposed from said top side to said bottom side; wherein said construction element pieces each further comprise a pair of apertures disposed in said piece from said top side to said bottom side along said first axis; and wherein said apertures are spaced apart a predetermined distance by a center post, said center post configured and dimensioned to be received into said second slot and held within said second inner indentations.

24. A planar construction toy formed of molded plastic, wherein said planar construction toy comprises a plurality of construction element pieces, said pieces each defining a first plane, each piece having a first end extending to a second end thereby defining an axis, said first end having a slot defined therein, said slot extending along a portion of said axis from said first end a predetermined distance towards said second end, said slot having an outer end adjacent said first end and an inner end, wherein said slot having defined therein a pair of opposing outer indentions within said slot adjacent said outer end, wherein said slot further having a pair of opposing inner indentations within said slot adjacent said inner end, said indentations configured for coupling with other construction element pieces, said piece further comprising at least one locking ridge adjacent said inner end for cooperating with the indentations on a second construction element piece to lock said pieces together; wherein said construction element pieces each have a top side opposite a bottom side, wherein said first slot is disposed from said top side to said bottom side; wherein said construction element pieces each further comprise a pair of apertures disposed in said piece from said top side to said bottom side along said first axis; and wherein said apertures are configured so said second construction element piece can be slid through said apertures.

25. A planar construction toy formed of molded plastic, wherein said planar construction toy comprises a plurality of construction element pieces, said pieces each defining a first plane, each piece having a first end extending to a second end thereby defining an axis, said first end having a slot defined therein, said slot extending along a portion of said axis from said first end a predetermined distance towards said second end, said slot having an outer end adjacent said first end and an inner end, wherein said slot having defined therein a pair of opposing outer indentions within said slot adjacent said outer end, wherein said slot further having a pair of opposing inner indentations within said slot adjacent said inner end, said indentations configured for coupling with other construction element pieces, said piece further comprising at least one locking ridge adjacent said inner end for cooperating with the indentations on a second construction element piece to lock said pieces together; wherein said construction element pieces each have a top side opposite a bottom side, wherein said first slot is disposed from said top side to said bottom side; wherein said construction element pieces each further comprise a pair of apertures disposed in said piece from said top side to said bottom side along said first axis; and wherein said construction element pieces further each comprise at least one aperture disposed in said piece from said top side to said bottom side along said first axis, said aperture comprising a plurality of flanges defining a plurality of orifices disposed at regular angles intersecting said first axis.

* * * * *